US005790925A

United States Patent [19]

Doi et al.

[11] Patent Number: 5,790,925

[45] Date of Patent: Aug. 4, 1998

[54] ELECTROPHOTOGRAPHIC IMAGE FORMING APPARATUS WITH LOW OZONE GENERATION

[75] Inventors: Isao Doi, Toyonaka; Keiko Momotani, Suita; Akihito Ikegawa, Sakai, all of Japan

[73] Assignee: Minolta Co., Ltd., Osaka, Japan

[21] Appl. No.: 803,465

[22] Filed: Feb. 20, 1997

[30] Foreign Application Priority Data

| | | | |
|---|---|---|---|
| Feb. 21, 1996 | [JP] | Japan | 8-033593 |
| Mar. 1, 1996 | [JP] | Japan | 8-045029 |
| Mar. 12, 1996 | [JP] | Japan | 8-54556 |
| Mar. 13, 1996 | [JP] | Japan | 8-056024 |

[51] Int. Cl.[6] ..... G03G 21/00

[52] U.S. Cl. ..... 399/135; 399/159; 399/154; 430/53

[58] Field of Search ..... 399/159, 154, 399/135, 136; 430/62, 66, 67, 68, 53

[56] References Cited

U.S. PATENT DOCUMENTS

| | | | |
|---|---|---|---|
| 3,772,010 | 11/1973 | Weiss | 399/159 X |
| 4,086,088 | 4/1978 | Toepke | 430/53 |
| 4,090,876 | 5/1978 | Furuya et al. | 430/53 X |
| 4,410,614 | 10/1983 | Lelental et al. | 430/62 X |
| 4,435,066 | 3/1984 | Tarumi et al. | 399/135 X |
| 5,161,233 | 11/1992 | Matsuo et al. | 399/136 |
| 5,450,168 | 9/1995 | Utsumi et al. | 399/159 |

*Primary Examiner*—Nestor R. Ramirez
*Attorney, Agent, or Firm*—McDermott, Will & Emery

[57] ABSTRACT

An image forming apparatus of the present invention comprises an image carrying member 2, a photosensitive member 9, a first voltage applying means 13, and an exposure means 5. The image carrying member 2 has an insulating layer 25 formed on a first conductive layer 23. The photosensitive member 9 has a photosensitive layer 93 formed on a second conductive layer 92. The photosensitive member 9 is supported so that the photosensitive layer 93 is opposed to the insulating layer 25 of the image carrying member 2. The first voltage applying means 13 applies a voltage between the first conductive layer 25 and the second conductive layer 92. A pattern-like surface electrode layer 98 is formed on the surface of the photosensitive layer 93 opposed to the image carrying member 2. A second voltage applying means 14 applies a bias voltage to the surface electrode layer 98. The exposure means exposes the photosensitive member 9 to discharge between the pattern-like surface electrode layer 98 and the image carrying member 2, thereby, an electrostatic latent image is formed on the surface of the image carrying member 2.

15 Claims, 14 Drawing Sheets

ELECTROPHOTOGRAPHIC IMAGE FORMING APPARATUS WITH LOW OZONE GENERATION

BACKGROUND OF THE INVENTION

The present invention relates to an image forming apparatus such as a copying machine, a printer or the like for forming an electrostatic latent image on an image carrier.

In an image forming apparatus such as a copying machine, a printer or the like of an electrophotographyic system, there is generally known an image forming method which comprises steps of electrically charging an electrostatic latent image carrier such as a photoreceptor by means of a charging unit, exposing the electrostatic latent image carrier to light to form an electrostatic latent image, developing the latent image by a toner to visualize the image, transferring this onto a transfer material and fixing it.

However, in the conventional image forming method accompanying corona discharge, a large amount of ozone is generated, leading to environmental destruction. Moreover, a significant influence is exerted on the surface of the photoreceptor, leading to a reduced operating life of the photoreceptor. For the above reasons, lately there has been a growing demand for providing an image forming method which suppresses the generation of ozone.

As an image forming method with a reduced amount of ozone, for example, the method disclosed in Japanese Patent Laid-Open Publication No. HEI 1-293358 has been proposed. According to this image forming method, a small piece of photosensitive member 101 and a cylindrical electric charge carrying member 102 are separately provided as shown in FIG. 25. The photosensitive member 101 is constructed by laminating a photoconductive layer support member 103, a photosensitive member electrode 104 and a photoconductive layer 105 in this order. On the other hand, the electric charge carrying member 102 is constructed by laminating an insulating layer support member 106, an electric charge carrying member electrode 107 and an insulating layer 108 in this order. The photosensitive member 101 and the electric charge carrying member 102 are arranged so that the photoconductive layer 105 and the insulating layer 108 face each other via an air gap.

By applying a voltage between the photosensitive member electrode 104 and the electric charge carrying member electrode 107 and performing scanning in the axial direction (main scanning direction) of the electric charge carrying member 102 with light incident on the photosensitive member 101 in a dark place, a portion of the photoconductive layer 105 exposed to the light comes to have a conductivity. Thus, an electric discharge is generated between the exposed portion and the insulating layer 108 of the electric charge carrying member 102, so that electric charges are accumulated in the insulating layer 108 of the electric charge carrying member 102 to form an electrostatic latent image. The formed electrostatic latent image is moved in a direction indicated by an arrow "b" in FIG. 25 to develop into a toner image by a developing unit 109. The toner image is transferred onto a paper or a film by a transfer charger 110.

With the aforementioned apparatus, an original document comprised of a plurality of long and short lines elongated in a sub-scanning direction as shown in FIG. 26A is exposed to light in the main scanning direction for the formation of an electrostatic latent image. Then, as shown in FIG. 26B, an image rear end portion of the electrostatic latent image formed on the electric charge carrying member 102 is disadvantageously elongated by $\Delta L$. The longer the line of the image is, the more significantly the elongation $\Delta L$ appears.

SUMMARY OF THE INVENTION

An object of the present invention is to provide an image forming apparatus which is possible to dissolve the elongation of the rear end portion of the image.

A further object of the present invention is to provide an image forming apparatus which is compact, low ozone, less expensive, and has good quality of image.

Excess carriers generated in the photosensitive member are gradually discharged after the completion of the exposure so that the electric discharge continue, causing the stop of the discharge not to coincide with the stop of the exposure, resulting in the elongation of the rear end of the latent image. The excess carriers mean carriers trapped by means of traps existing in the photosensitive member or, in the case of the layered photosensitive member, traps formed in the vicinity of the interface of the layered photosensitive member, carriers having a very slow transporting velocity among free carriers, or carriers which is not spent in the electric discharge among the carriers generated by the exposure.

It is considered as one reason of the generation of the excess carriers that the charged area on the insulating layer of the image carrying member according to the present exposure overlaps the charged area according to the previous exposure, causing the electric potential of the insulating layer in the overlapped area to rise, reducing the strength of the electric field applied to the photosensitive layer, whereby a part of the excess carriers generated in the exposure area of the photosensitive member is left undischarged in the photosensitive layer as excess carriers.

The present invention is directed to the following two ways in order to dissolve the elongation of the rear end portion of the image. The first is to eliminate the excess carriers at the time of stopping the exposure. The second is to avoid the generation of the excess carriers.

(1) In order to achieve the aforementioned object, according to one aspect of the present invention, there is provided an image forming apparatus, comprising:

- an image carrying member having an insulating layer formed on a first conductive layer;
- a photosensitive member having a photosensitive layer formed on a second conductive layer, the photosensitive member being supported so that the photosensitive layer opposed to the insulating layer of the image carrying member;
- a first voltage applying means for applying a voltage between the first conductive layer and the second conductive layer;
- a pattern-like surface electrode layer formed on the surface of the photosensitive layer opposed to the image carrying member;
- a second voltage applying means for applying a bias voltage to the surface electrode layer; and
- an exposure means for exposing the photosensitive member for generating charge in the photosensitive member to discharge between the pattern-like surface electrode layer and the image carrying member, thereby, an electrostatic latent image is formed on the surface of the image carrying member.

In the image forming apparatus so constructed above, the photosensitive member is exposed in a state that a voltage is applied between the first conductive layer of the image carrying member and the second conductive layer of the photosensitive member, and that a bias voltage is applied to the surface electrode layer. Thus, carrier pairs are generated in the photosensitive member. Free carriers in the generated carrier pairs move to the surface of the photosensitive layer. According to this phenomenon, the electric field between the photosensitive layer and the image carrying member rises. Then, the electric discharge occurs, whereby an electrostatic latent image is formed on the image carrying member.

On the other hand, excess carriers in the generated carrier pairs move toward the surface electrode layer of the photosensitive layer without accumulating in the photosensitive layer by virtue of the electric field between the first conductive layer of the image carrying member and the surface electrode layer of the photosensitive member. Then, the excess carriers are discharged, or trapped by the surface electrode layer. Thus, it is eliminated that the excess carriers are gradually discharged after the completion of the exposure, whereby the electric discharge does not continue, avoiding the elongation of the rear end of the latent image.

Preferably, the pattern-like surface electrode layer may be coated with an insulating protection layer, preventing oxidation of the surface electrode layer which is exposed to the discharge and avoiding local, abnormal discharge.

Preferably, the pattern of the pattern-like surface electrode layer may be a shape having at least one slit or a mesh.

Preferably, the slit of the pattern-like surface electrode layer may have a width of 10 to 150 microns, and the conductive portion which form the slit may have a width of 2 to 50 microns.

Preferably, the pattern-like surface electrode layer may have an opening ratio of more than 0.7. An electric field strength between the second conductive layer and the surface electrode layer may be more than 40 V/micron.

(2) According to another aspect of the present invention, there is provided an image forming apparatus, comprising:

an image carrying member having an insulating layer formed on a first conductive layer, the image carrying member moving toward a direction;

a photosensitive member having a photosensitive layer formed on a second conductive layer, the photosensitive member being supported so that the photosensitive layer opposed to the insulating layer of the image carrying member, the photosensitive layer comprising a charge generating layer which generates charge when irradiating light and a charge transporting layer which transport the charge from the charge generating layer to the surface of the photosensitive member, the charge generating layer being formed in a belt-like shape and extending at right angle to the moving direction of the image carrying member;

a voltage applying means for applying a voltage between the first conductive layer and the second conductive layer; and an exposure means for exposing the photosensitive member for generating charge in the charge generating layer, said generated charge is transported toward to the surface of the photosensitive member for discharging between the photosensitive member and the image carrying member to form an electrostatic latent image on the image carrying member.

In the image forming apparatus so constructed above, the belt-like shape of the charge generating layer of the photosensitive member is exposed. Thus, carrier pairs are generated in a restricted area of the photosensitive member, causing the electric discharge to occur in a restricted area on the image carrying member. As a result, the charged area on the image carrying member does not overlap in the moving direction of the image carrying member, avoiding the generation of the excess carriers. Therefore, all of the carriers generated in the charge generating layer of the photosensitive layer is spent in the electric discharge, avoiding the elongation of the rear end of the latent image.

Preferably, the charge generating layer may have a width narrower than the diameter, in the moving direction of the image carrying member, of the light irradiated from the light source. Thus, the distribution of the charge quantity on the charged area of the image carrying member in the moving direction becomes to rectangular shape, enabling the image carrying member to charge uniformly, which increases sharpness of the image.

Preferably, the belt-like shape of the charge generating layer may be discontinuity.

(3) According to another aspect of the present invention, there is provided an image forming apparatus, comprising:

an image carrying member having an insulating layer formed on a first conductive layer, the image carrying member moving toward a direction;

a photosensitive member having a photosensitive layer formed on a second conductive layer, the photosensitive member being supported so that the photosensitive layer opposed to the insulating layer of the image carrying member;

a voltage applying means for applying a voltage between the first conductive layer and the second conductive layer;

a shield member for shielding a portion of the light irradiated from the exposure means, the shield member being a shape having at least one slit extending at right angle to the moving direction of the image carrying member; and an exposure means for exposing the photosensitive member for generating charge in the photosensitive member to discharge between the image carrying member and the photosensitive member, thereby, an electrostatic latent image is formed on the surface of the image carrying member.

In the image forming apparatus so constructed above, the photosensitive member is exposed through the slit of the shield member. Thus, carrier pairs are generated in a restricted area of the photosensitive member, thereby the charged area on the image carrying member does not overlap in the same manner as described before, avoiding the generation of the excess carriers.

(4) According to another aspect of the present invention, there is provided an image forming apparatus, comprising:

an image carrying member having an insulating layer formed on a first conductive layer, the image carrying member moving toward a direction;

a photosensitive member having a photosensitive layer formed on a second conductive layer, the photosensitive member being supported so that the photosensitive layer opposed to the insulating layer of the image carrying member, the second conductive layer being formed in a belt-like shape and extending at right angle to the moving direction of the image carrying member;

a voltage applying means for applying a voltage between the first conductive layer and the second conductive layer; and an exposure means for exposing the photosensitive member for generating charge in the photosensitive member to discharge between the image carrying member and the photosensitive member, thereby, an electrostatic latent image is formed on the surface of the image carrying member.

In the image forming apparatus so constructed above, since the conductive layer of the photosensitive member is formed in a belt-like shape, the area of the electric field formed on the photosensitive layer is restricted. Thus, carrier pairs are generated in a restricted area of the photosensitive layer on which is applied the electric field, thereby the charged area on the image carrying member does not overlap in the same manner as described before, avoiding the generation of the excess carriers.

Alternatively, in stead of the belt-like shape of the second conductive layer, the second conductive layer may have a projection which is formed in a belt-like shape and extends at right angle to the moving direction of the image carrying member. In this case, the electric field applied to the photosensitive layer is concentrated on the projection and the area of the electric field is restricted.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

First Embodiment

Figure 1:
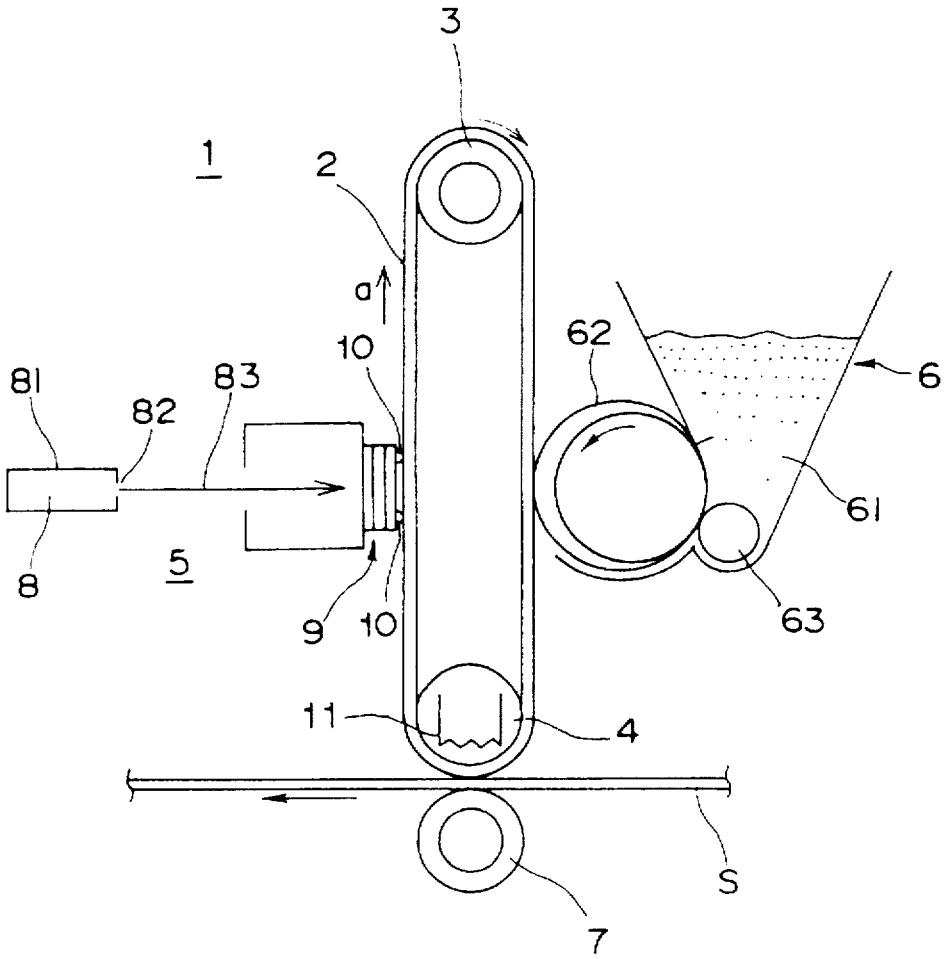
FIG. 1 is a sectional view of the image forming apparatus of according to a first embodiment of the present invention.
Figure 2:
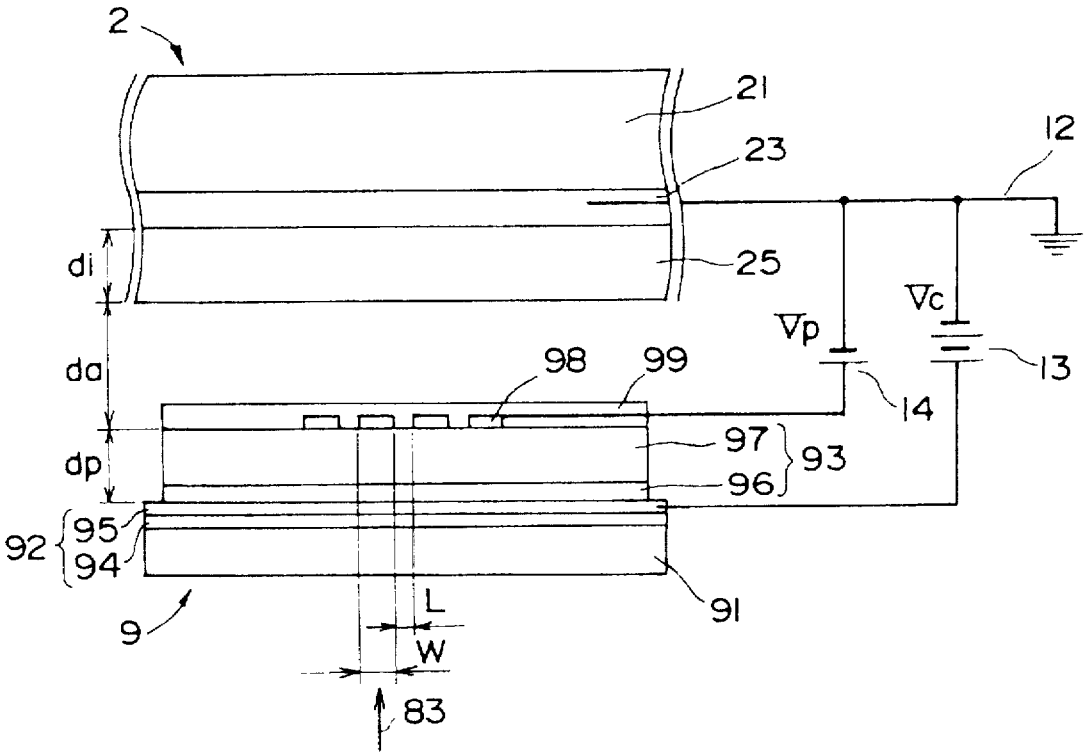
FIG. 2 is an enlarged sectional view of a portion of the image forming apparatus of FIG. 1.

FIG. 1 shows a schematic view of an image forming apparatus 1 according to a first embodiment, while FIG. 2 shows a partially enlarged sectional view of an essential part of a photosensitive member 9 and an image carrying belt 2.

In a center portion of the image forming apparatus 1 is arranged the image carrying belt 2 which serves as an image carrying member. This image carrying belt 2 is made to run in a direction indicated by an arrow "a" by a driving roller 3 which is rotated by a drive unit (not shown) and a heating roller 4 provided in parallel with the driving roller 3.

As shown in FIG. 2, the image carrying belt 2 is provided by forming a conductive layer 23 on a surface of a base 21 comprised of a dielectric material and forming a dielectric layer 25 which serves as an insulating layer on it. In concrete, it is constructed so that the conductive layer 23 is provided on the base 21 comprised of a polyimide film having a thickness of 50 μm, a width of 25 cm and a perimeter of 30 cm, and the dielectric layer 25 comprised of a fluororesin having a thickness of several micrometers is further provided on it. The conductive layer 23 is grounded by a conductive wire 12.

It is to be noted that the construction of the image carrying member is not limited to this kind of belt, and it may have a drum-like shape.

Around the aforementioned image carrying belt 2 are provided a latent image forming unit 5, a developing unit 6 and a transfer roller 7 in this order in the direction indicated by the arrow "a" in FIG. 1.

The latent image forming unit 5 is comprised of an optical system 8 and a photosensitive member 9 arranged between the optical system 8 and the image carrying belt 2. The optical system 8 is constructed by arranging in a housing 81 a semiconductor laser generator, a collimator lens, a polygon mirror, an Fθ-lens, a reflecting mirror and so forth, where an exposure slit 82 is formed at a wall portion of the housing 81. This optical system 8 is constructed so that a laser light beam 83 generated by the semiconductor laser generator is applied through the exposure slit 82 to the photosensitive member 9, thereby allowing image exposure to be achieved. It is to be noted that an optical system for performing a scanning exposure at a resolution of 300 d.p.i. is used in the present embodiment.

In this case, the direction in which the laser light beam 83 performs the scanning exposure is the widthwise direction of the image carrying belt 2 (in the front-back direction in FIG. 1), and this direction will be referred to as a main scanning direction hereinafter. Further, the direction in which the image carrying belt 2 runs (the vertical direction in FIG. 1) perpendicularly to the main scanning direction will be referred to as a sub-scanning direction.

The photosensitive member 9 is constructed so that a transparent conductive layer 92, a photosensitive layer 93, a surface electrode layer 98 and a surface protection layer 99 are laminated in this order on a transparent substrate 91 as shown in FIG. 2.

The transparent substrate 91 is made of transparent glass plate. The transparent conductive layer 92 is comprised of an ITO film 94 and a polyamide resin layer 95. Further, to the transparent conductive layer 92 is connected a first power source 13.

The photosensitive layer 93 is for negative charges and has a good sensitivity to light of a long wavelength such as a semiconductor laser light (having a wavelength of 780 nm) or an LED light (having a wavelength of 680 nm). The photosensitive layer 93 is a function separating type and is comprised of a charge generating layer (CGL) 96 having a carrier pairs generating function and a charge transporting layer (CTL) 97 having a free carriers transferring function.

Figure 3:
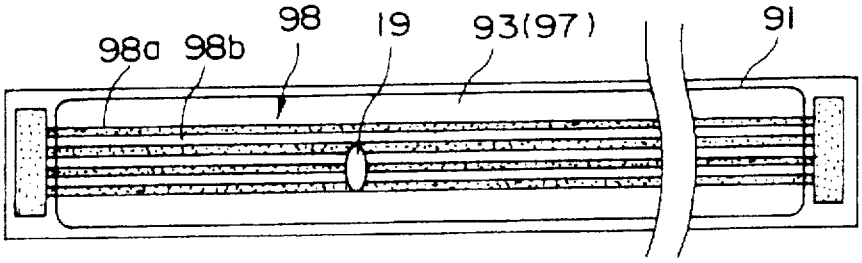
FIG. 3 is a view showing a pattern shape of the surface electrode layer of the photosensitive member.

The surface electrode layer 98 has a shape such that four belt-liked conductive sections 98*a* which are parallel to one another as shown in FIG. 3 are provided in the main scanning direction, thereby providing three slits 98*b* between them. To this surface electrode layer 98 is connected a second power source 14.

The surface protection layer 99 is provided by forming an amorphous carbon film obtained by plasma-polymerizing 1, 3-$C_4H_6$ to a thickness of 0.15 μm. This surface protection layer 99 is not always necessary. However, for the purpose of preventing the oxidation of the surface electrode layer 98 that is exposed to electric discharge and preventing a local abnormal electric discharge, it is preferable to provide the insulative surface protection layer 99 on the surface electrode layer 98.

Between the photosensitive member 9 and the image carrying belt 2 is provided an air gap by a spacer 10 comprised of a fluororesin as shown in FIG. 1, so that the photosensitive layer 93 of the photosensitive member 9 and the dielectric layer 25 of the image carrying belt 2 face each other via the air gap.

In this case, the photosensitive member 9 is not in contact with the image carrying belt 2, and therefore, a stable latent image can be easily formed without contaminating the surface of the photosensitive member 9 even when a foreign object is conveyed in company with the run of the image carrying belt 2. Furthermore, the material to serve as the spacer 10 is not specifically limited to the fluororesin, and it is acceptable to use a material which has a small coefficient of friction with respect to the image carrying belt 2 and hardly impairs it.

The aforementioned developing unit 6 is comprised of a toner storage section 61 for storing therein a single-component developer (referred to as a toner hereinafter), a developing sleeve 62 arranged in close vicinity to the image carrying belt 2 and a supply roller 63 for supplying the toner stored in the toner storage section 61 to the developing sleeve 62 while agitating the toner. The toner to be used in this developing unit 6 is a negative charge type and has a mean particle diameter of 10 μm obtained by kneading, pulverizing and classifying by a known method a mixture having bisphenol A polyester resin and carbon black as main ingredients.

To the developing sleeve 62 is applied an appropriate developing bias voltage for the purpose of preventing a background fogging and the like.

The transfer roller 7 faces the heating roller 4 via the image carrying belt 2 and is arranged in pressure contact with the image carrying belt 2. A recording paper S is made to pass between this transfer roller 7 and the image carrying belt 2.

In regard to the image forming apparatus 1 constructed as above, a latent image forming process will be described first.

A voltage of 1.5 kV($V_c$) is applied to the transparent conductive layer 92 of the photosensitive member 9 by the first power source 13, while a voltage of 50 V($V_p$) is applied to the surface electrode layer 98 by the second power source 14. Therefore, an electric field due to a voltage difference of 1.5 kV is formed between the conductive layer 23 of the grounded image carrying belt 2 and the transparent conductive layer 92, while an electric field due to a voltage difference of 1.45 kV is formed between the surface electrode layer 98 and the transparent conductive layer 92.

When the laser light beam 83 generated by the optical system 8 is applied for exposure to the photosensitive member 9 in the state in which the electric fields are formed as described above, the laser light beam 83 transmits itself through the transparent substrate 91 and the transparent conductive layer 92 to reach the charge generating layer 96. The charge generating layer 96 generates carrier pairs upon absorbing light under the existence of an electric field. Among the generated carrier pairs, each freed carrier moves toward the opposite electrode having the inverse polarity. In this stage, each freed positive carrier moves through the inside of the charge transporting layer 97 to the surface of the photosensitive layer 93. By this operation, the electric field in the air gap between the surface of the photosensitive layer 93 and the surface of the image carrying belt 2 increases. When this electric field exceeds a threshold value determined upon a Paschen's law, an electric discharge is generated and the surface of the dielectric layer 25 of the image carrying belt 2 corresponding to the position of exposure of the photosensitive member 9 is electrically charged, so that an electrostatic latent image is formed. In this stage, carriers caught by the traps formed in the photosensitive layer 93 and in the vicinity of the interface between the charge generating layer 96 and the charge transporting layer 97 as well as free carriers having a very slow moving velocity inside the photosensitive layer 93 are generated as excess carriers. These excess carriers form a space charge inside the photosensitive layer 93 when the quantity of light for exposure is weak and the electric field inside the photosensitive layer 93 is small, consequently exerting a bad influence on the latent image after the completion of the exposure, and this causes the elongation at the image rear end portion.

However, since the photosensitive member 9 is provided with the surface electrode layer 98 formed on the surface of the photosensitive layer 93 and the bias voltage is applied from the second power source 14 thereto, the electric field inside the photosensitive layer 93 is kept at a very high electric field. Therefore, the excess carriers reach the surface of the photosensitive layer 93 without delay to be discharged or caught by the surface electrode layer 98, and therefore, no accumulation of excess carriers occurs in the photosensitive layer 93. Accordingly, there occurs no such phenomenon that the electric discharge continues even after the completion of the exposure causing the elongation at the image rear end portion. By thus providing the surface electrode layer 98, the electric discharge is completed immediately in synchronization with the completion of the exposure, thereby allowing the desired latent image approximately equal to the exposed image to be formed.

A process after the formation of the latent image will be described as follows.

The electrostatic latent image formed on the image carrying belt 2 is conveyed to the developing section by the rotation of the driving roller 3 and the heating roller 4 and then developed with toner by the developing unit 6. Subsequently, a toner image formed on the image carrying belt 2 is further conveyed by the rotation of the driving roller 3 and the heating roller 4 and heated by a heating member 11 provided inside the heating roller 4 while being concurrently transferred onto a recording paper S by the transfer roller 7. In this stage, the toner image is fused and transferred, and therefore, no toner is left on the image carrying belt 2, meaning that almost whole the toner is transferred onto the recording paper S and concurrently fixed.

As the photosensitive member 9 of the aforementioned embodiment, one manufactured by the following method is used.

First, a base was made by forming the transparent conductive layer 92 on the surface of an approximately plate-shaped transparent substrate 91 elongated in the main scanning direction, or in detail, a transparent glass plate having a width of 250 mm in the main scanning direction, a width of 30 mm in the sub-scanning direction and a thickness of 3 mm. For the transparent conductive layer 92, the ITO film 94 was formed by a thickness of about 0.2 μm by the known ion plating method (it is assumed that the ITO film has a sheet resistivity of about 100 Ω/□), and an about 0.5 μm thick of polyamide resin layer 95 was further coated as an injection preventing layer on it by the dipping method.

Subsequently, one part by weight of τ (tau) type metal-free phthalocyanine, two parts by weight of polyvinyl butyral resin and 100 parts by weight of tetrahydrofuran were put in a ball mill pot and dispersed for 24 hours, so that a photosensitive paint was obtained. The photosensitive paint has a viscosity of 15 cp at a temperature of 20° C. in this stage. As the polyvinyl butyral resin, one which has a degree of acetylation of not greater than three molar percent, a degree of butylation of 70 molar percent and a degree of polymerization of 1000 was used.

Then, this photosensitive paint was coated on the surface of the transparent conductive layer 92 of the aforementioned base by the dipping method, so that a charge generating layer 96 having a film thickness of 0.4 μm was formed after drying.

Then, a coating liquid in which eight parts by weight of a hydrazone compound expressed by the following structural formula (Formula 1), 0.1 part by weight of an orange pigment and 10 parts by weight of polycarbonate resin are dissolved in a solvent comprised of 180 parts by weight of tetrahydrofuran was coated on the charge generating layer 96 by the dipping method and dried, so that the charge transporting layer 97 having a film thickness of 21 μm was formed.

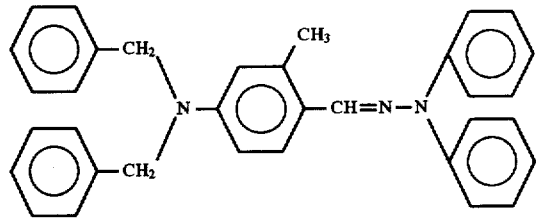

Then, the surface electrode layer 98 having the slit pattern as shown in FIG. 3 was provided on the surface of the photosensitive layer 93, or in detail, on the surface of the charge transporting layer 97, and the surface protection layer 99 was further formed on it. The surface electrode layer 98 of this slit pattern was formed by vapor depositing aluminum in a state in which a mask sheet is tightly fit on the surface of the photosensitive layer 93 and thereafter removing the mask.

The belt-liked conductive sections 98 forming the slits 99 of the surface electrode layer 98 has a thickness of 0.1 μm. There is no specific problem if it has an approximately uniform thickness within a range in which the adhesion with the photosensitive layer 93 can be assured and there is no problem of strength in terms of practical handling and durability, and it is considered appropriate that the thickness is not smaller than 0.03 μm and not greater than 5 μm. Furthermore, as described later, it is preferable that the slit width L is not smaller than 10 μm and not greater than 150 μm, and it is preferable that the width W of the belt-liked conductive section is not smaller than 2 μm and not greater than 50 μm.

In a manner as described above, the transparent conductive layer 92 was formed on the transparent substrate 91 for the provision of the base, the charge generating layer (CGL) 96 and the charge transporting layer (CTL) 97 which serve as the function separating type photosensitive layer 93 were on it, and the surface electrode layer 98 and the surface protection layer 99 were further formed on it, so that the photosensitive member 9 was obtained.

In regard to the construction of the photosensitive layer 93, it may be an inverted laminate type or so-called the single layer type instead of the aforementioned function separating type. Furthermore, it is proper to appropriately select a known material for the charge generating material, charge transfer material, binding resin and additives according to purposes. In addition, the photosensitive material is not limited to the organic material, and it is acceptable to use an inorganic material such as zinc oxide, cadmium sulfide, selenium based alloy, amorphous silicon based alloy or amorphous germanium alloy. Furthermore, it is acceptable to provide a known undercoating layer for the purpose of improving the charge characteristic, image quality and adhesion to the base. Furthermore, there is no limitation on the base so long as it has a conductivity at it surface and is a substrate transparent with respect to light for exposure to be able to serve as a support body.

For the surface electrode layer 98, a metal material such as such as chromium, titanium, magnesium, gold or platinum, or a conductive oxide film such as tin oxide, indium oxide or ITO, or a material such as a conductive paste or a conductive ink can be used instead of aluminum. There is no specific limitation on the surface electrode layer 98 so long as it is conductive. However, particularly in a construction in which no surface protection layer 99 is provided, the surface electrode layer 98 is directly exposed to electric discharge, and therefore, it is preferable to use a material of which oxidation hardly progresses.

The method of forming the surface electrode layer 98 is not limited to this, and it is acceptable to form an electrode by the ion plating method or the sputtering method instead of vapor deposition. Furthermore, it is acceptable to form a pattern by a photolithographic method after forming the electrode by the aforementioned method without using any mask sheet. Furthermore, it is acceptable to perform printing by using a conductive paste or a conductive ink.

For the surface protection layer 99, an insulating organic film such as polyester or polyamide, an organic plasma polymer film such as amorphous carbon or a material of a metal oxide film such as alumina, titanium oxide or silicon oxide can be used. Furthermore, it is preferable to make the film thickness of the surface protection layer 99 as thin as possible so that influence is exerted neither on voltage drop nor carriers movement, and it is generally considered appropriate that the thickness is not smaller than 0.05 μm and not greater than 2 μm.

A dielectric material which can be used for the base 21 and the dielectric layer 25 of the image carrying belt 2 of the aforementioned embodiment is limited neither to the aforementioned polyimide nor fluororesin, and it is acceptable to use the material of polyethylene, polypropylene, ionomer, polyvinyl alcohol, polyvinyl acetate, ethylene-vinyl acetate copolymer, poly-4-methylpentene-1, polymethyl methacrylate, polycarbonate polystyrene, acrylonitrile-methyl acrylate copolymer, acrylonitrile-butadiene-styrene copolymer, polyethylene terephthalate, polyurethane elastomer, cellulose acetate, cellulose triacetate, cellulose nitrate, cellulose propionate, cellulose acetate butyrate, ethyl cellulose, regenerated cellulose, nylon 6, nylon 66, nylon 11, nylon 12, polysulfone, polyether sulfone, polyvinyl chloride, vinyl chloride-vinyl acetate copolymer, polyvinylidene chloride, vinylidene chloride, vinyl chloride copolymer, vinyl nitrile rubber alloy, polytetrafluoroethylene, polychloro-trifluoroethylene, polyvinyl fluoride, polyvinylidene fluoride, or polyethylene-tetrafluoroethylene copolymer.

It is to be noted that the electric resistivity of the material of the aforementioned dielectric layer 25 is preferably set to $10^{11}$ Ωcm or higher in order to prevent the reduction of the charge potential with the elapse of time. There is no limitation on the thickness of the dielectric layer 25 if it is within the range in which there is no problem of strength in terms of practical handling and durability, and it is generally considered appropriate that the thickness is 2 to 100 μm.

A concrete experiment performed for confirming the effect of the image forming apparatus of the aforementioned embodiment, i.e., the effect of removing the elongation at the image rear end portion will be described next.

This experiment was performed by changing the conditions with regard to the construction of the photosensitive member 9 and the image carrying belt 2 shown in FIG. 2 and the surface electrode layer 98 of the slit pattern of the construction shown in FIG. 3. As conditions common to all the experimental examples, a film thickness $d_p$ of the photosensitive layer 93 was set to 21 μm, a thickness $d_a$ of the air layer (a distance from the surface of the photosensitive layer 93 to the surface of the dielectric layer 25) was set to 30 μm, and a film thickness $d_i$ of the dielectric layer 25 of the image carrying belt 2 was set to 15 μm. Further, a system velocity (the moving velocity of the image carrying belt 2) was set to 38 mm/sec, a quantity of light for exposure of the photosensitive member 9 was set to 0.35 mW/dot, and a diameter of an exposure light beam spot 19 in the stage of exposure was set to 140 μm. The other constructions and materials were as described above.

The conditions of the experimental examples and a comparative example and experiment results are shown in Table 1.

In the experimental examples 1 through 9, the voltage at the transparent conductive layer 92 of the photosensitive member was set to 1.5 kV, the voltage at the surface electrode layer 98 was set to 50 V, and the width W of the belt-liked conductive section 98 and the width L of the slit 99 (a distance between the belt-liked conductive sections) were changed. Next, in the experimental examples 10 through 16, the voltage applied to the transparent conductive layer 92 of the photosensitive member 9 and the voltage applied to the surface electrode layer 98 of the slit pattern were changed by means of the surface electrode layer 98 having a slit pattern such that the width W of the belt-liked conductive section 98 was set to 30 μm and the width (the distance between the belt-liked conductive sections) L of the slit 99 was set to 90 μm. Further, one having no surface electrode layer 98 was used as a comparative example.

Figure 10:
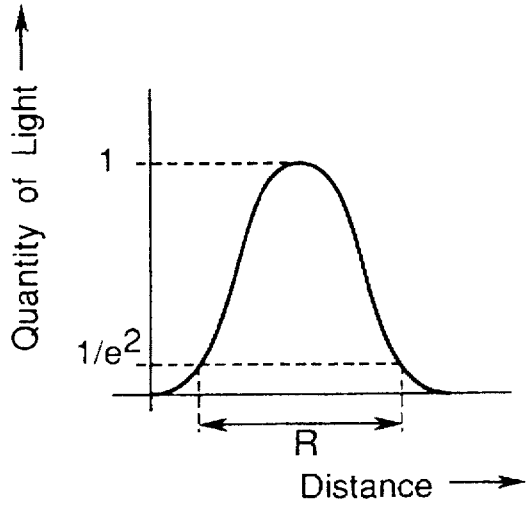
FIG. 10 is a graph showing a distribution of quantity of light of laser light beam.

The experimental examples and the comparative example were each measured with regard to a n elongation ΔL (see FIG. 10 (b)) of the line length of the toner image reproduced actually on the recording paper S by being exposed by a beam of laser light to a test pattern consisting of longitudinal lines (lines in the sub-scanning direction) having a length of 10 mm to 40 mm and a width of four dots.

Evaluation was made in terms of the measured values of ΔL ranked as follows.

an excellent state within a range of ±30 μm:◎ a good state within a range of ±50 μm:○ an acceptable state within a range of ±100 μm: ◇ an unsatisfactory state within a range of ±200 μm:Δ a practically problematic state having a range of more than the above: x

It is to be noted that any case where no evaluation can be made for a problem of the image was marked with "-".

TABLE 1

| | L [μm] | W [μm] | L/(L + W) | $V_p$ [v] | $V_c$ [v] | $V_c - V_p/d_p$ | ΔL[μm] | Evaluation |
|---|---|---|---|---|---|---|---|---|
| Exp. ex. 1 | 90 | 30 | 0.75 | 50 | 1500 | 69 | 32 | ○ |
| ex. 2 | 130 | 30 | 0.81 | 50 | 1500 | 69 | 45 | ○ |
| ex. 3 | 50 | 20 | 0.71 | 50 | 1500 | 69 | 12 | ◎ |
| ex. 4 | 90 | 20 | 0.82 | 50 | 1500 | 69 | 25 | ◎ |
| ex. 5 | 35 | 10 | 0.78 | 50 | 1500 | 69 | 8 | ◎ |
| ex. 6 | 35 | 45 | 0.44 | 50 | 1500 | 69 | *1 | – |

TABLE 1-continued

| | L [μm] | W [μm] | L/(L + W) | $V_p$ [v] | $V_c$ [v] | $V_c - V_p/d_p$ | ΔL[μm] | Evaluation |
|---|---|---|---|---|---|---|---|---|
| ex. 7 | 180 | 45 | 0.80 | 50 | 1500 | 69 | 800 | Δ |
| ex. 8 | 150 | 30 | 0.83 | 50 | 1500 | 69 | 75 | ◊ |
| ex. 9 | 90 | 60 | 0.60 | 50 | 1500 | 69 | *2 | – |
| ex. 10 | 90 | 30 | 0.75 | −100 | 1400 | 71 | 31 | ○ |
| ex. 11 | 90 | 30 | 0.75 | 200 | 1300 | 52 | 40 | ○ |
| ex. 12 | 90 | 30 | 0.75 | −100 | 1200 | 62 | 25 | ⊙ |
| ex. 13 | 90 | 30 | 0.75 | 50 | 1200 | 55 | 35 | ○ |
| ex. 14 | 90 | 30 | 0.75 | 400 | 1200 | 38 | 253 | Δ |
| ex. 15 | 90 | 30 | 0.75 | 300 | 1000 | 33 | 355 | Δ |
| ex. 16 | 90 | 30 | 0.75 | 500 | 1000 | 24 | 650 | Δ |
| Com. ex. 0 | No surface electrode was provided. | | | | 1500 | | 3000 | x |

*1: No image was formed.
*2: A dot image was formed.

According to the experimental examples 1 through 9, it is considered appropriate that the width (the distance between the belt-liked conductive sections 98) L of the slit 99 is 10 μm to 150 μm. This is because it is apprehended that an image density may reduce when the width L of the slit 99 is smaller than 10 μm and because the effect on the elongation of the image is scarcely expected when the width L of the slit 99 exceeds 150 μm. In practice, it is preferable to set the slit width L within a range of 35 μm to 130 μm.

Next, it is considered appropriate that the width (electrode width between the slits 99) W of the belt-liked conductive sections 98 in the sub-scanning direction is within a range of 2 μm to 50 μm. This is because it is apprehended that a nonuniformity may occur in the image due to a voltage drop when the width W of the belt-liked conductive section 98 is smaller than 2 μm and because it is apprehended that the image density may reduce or the formed image may be a fragmentary dot image when the width W of the belt-liked conductive section 98 exceeds 50 μm. In practice, it is preferable to set the width W of the belt-liked conductive section 98 within a range of 10 μm to 30 μm.

In addition, it is considered desirable that a numerical aperture L/(L+W) is not smaller than 0.7 within the appropriate ranges of the width L of the slit 99 and the width W of the belt-liked conductive section 98. This is because, if the numerical aperture is smaller than 0.7, it is apprehended that some, which will contribute to the electric discharge, of the carriers generated by the exposure reduces in amount, causing a reduced image density or a fragmentary dot image of the formed image.

Next, from the results of the experimental examples 10 through 16, it is considered appropriate that the voltage $V_c$ applied to the transparent conductive layer 92 of the photosensitive member 9 is within a range of ±(800 to 2000) V. This is because it is apprehended that a noise may occur due to an abnormal electric discharge when a voltage higher than 2000 V is applied and it is apprehended that the image density may reduce when the voltage is lower than 800 V. Furthermore, it is considered appropriate that the application voltage $V_p$, to the surface electrode layer 98 is within a range of (−400 to +1000) V when the voltage $V_c$ has a positive polarity or within a range of (−1000 to +400) V when the voltage $V_c$ has a negative polarity. In regard to the elongation of the image, the influence of the excess carriers inside the photosensitive layer 93 is significant, and therefore, practically it is considered to be related to the electric field effected in the photosensitive layer 93. Therefore, in order to obtain an effect on the elongation, it is considered necessary to determine the voltage $V_p$ to be applied to the surface electrode layer 98 in correspondence with the voltage $V_c$ to be applied to the transparent conductive layer 92 of the photosensitive member 9 so that $|(V_c-V_p)/d_p|$ becomes not lower than 40 V/μm.

FIGS. 4 through 7 show variations of the surface electrode layer 98.

Figure 4:
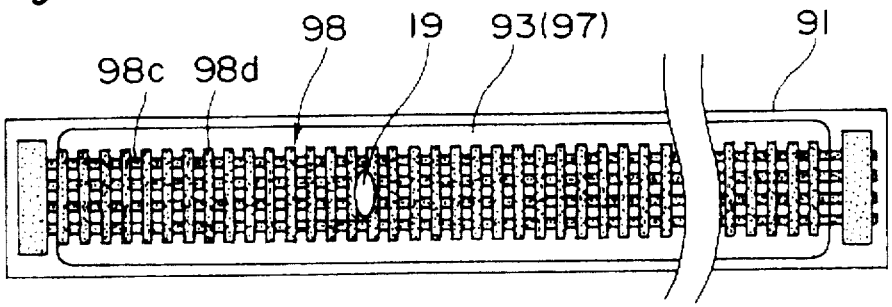
FIG. 4 is a view showing a pattern shape of the surface electrode layer of another variation of FIG. 3.

The one shown in FIG. 4 is constructed so that four mutually parallel belt-liked conductive sections **98*c* are arranged in the main scanning direction and a number of mutually parallel strip-shaped conductive sections 98*d*** are arranged in the sub-scanning direction, exhibiting a grating-like configuration.

Figure 5:
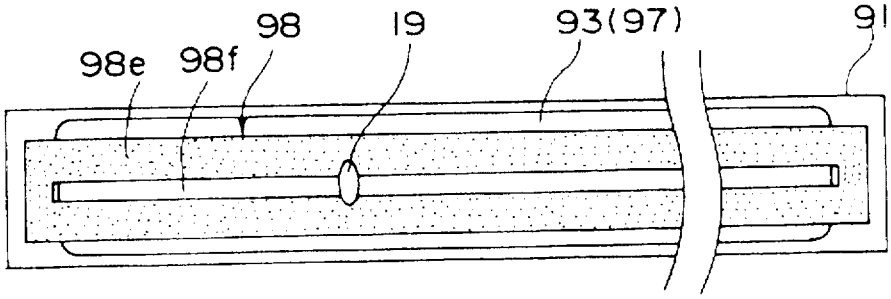
FIG. 5 is a view showing a pattern shape of the surface electrode layer of the another variation of FIG. 3.

The one shown in FIG. 5 is constructed so that two mutually parallel belt-liked conductive sections **98*e* are arranged in the main scanning direction, and only one slit 98*f* is formed between them. As described above, it is not always required to provide a plurality of slits, but it is required to provide at least one slit in a position in the main scanning direction in which the exposure light beam spot 19** is applied.

Figure 6:
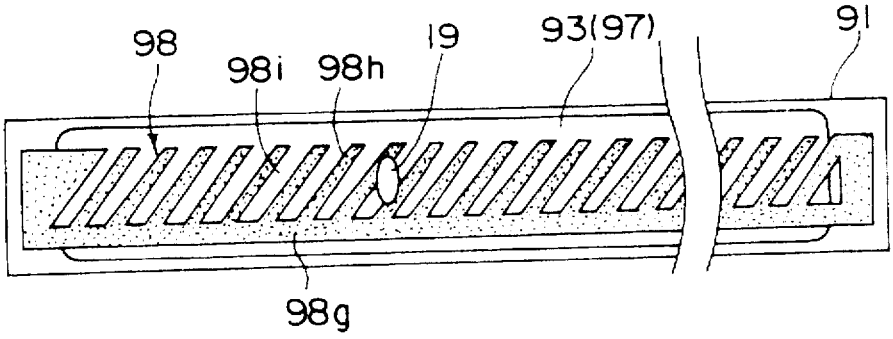
FIG. 6 is a view showing a pattern shape of the surface electrode layer of the another variation of FIG. 3.

Further, the one shown in FIG. 6 is constructed so that one belt-liked conductive section **98*g* is arranged in the main scanning direction and a number of mutually parallel strip-shaped conductive sections 98*h* are arranged aslant with respect to both the main scanning direction and the sub-scanning direction, so that slits 98*i*** are formed obliquely.

Figure 7:
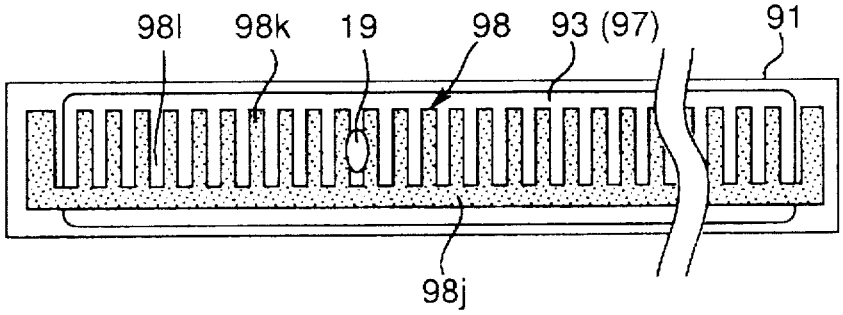
FIG. 7 is a view showing a pattern shape of the surface electrode layer of the another variation of FIG. 3.

Further, the one shown in FIG. 7 is constructed so that one belt-liked conductive section **98*j* is arranged in the main scanning direction and a number of mutually parallel strip-shaped conductive sections 98*k* are arranged perpendicular to the main scanning direction in a comb-like configuration, forming slits 98*l***.

The surface electrode layer 98 may have any other shape so long as the numerical aperture is not smaller than 70% in the area of exposure of the photosensitive layer 93 and no influence is exerted on the image. Furthermore, the surface electrode layer 98 is not always required to be placed on the surface of the photosensitive layer 93, but it is required to be placed in a position where it can remove the electric discharge after the exposure due to the excess carriers in the vicinity of the surface of the photosensitive layer 93.

Second Embodiment

Figure 8:
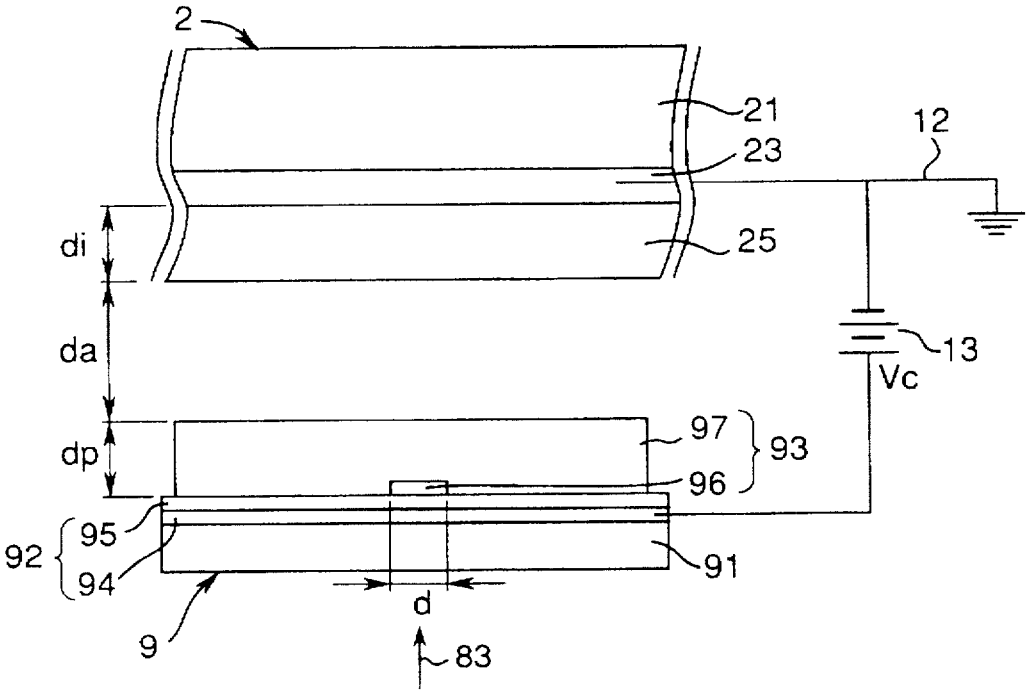
FIG. 8 is an enlarged sectional view of a portion of the image forming apparatus according to a second embodiment of the present invention.

FIG. 8 shows a second embodiment of photosensitive member 9 of the image forming apparatus according to the present invention. The photosensitive member 9 is similar to the photosensitive member 9 in FIG. 2 except that there is no surface electrode layer on the photosensitive layer 93 and that the charge generating layer 96 of the photosensitive layer 93 is formed in a belt-like shape.

Figure 9:
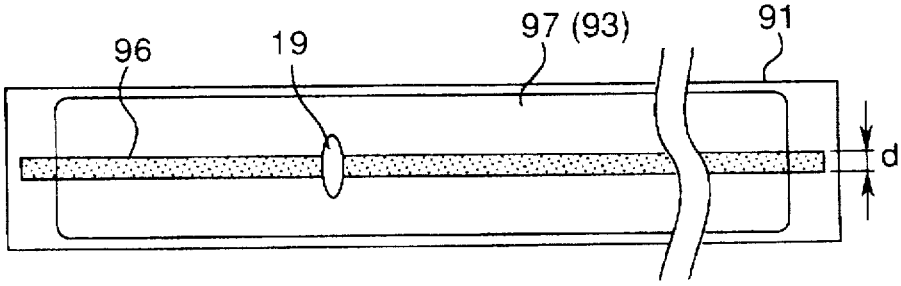
FIG. 9 is a view showing a pattern shape of the charge generating layer of the photosensitive member.

The belt-like charge generating layer 96, as shown in FIG. 9, has a width d of 90 μm in the sub-scanning direction and extends to the main scanning direction.

In the second embodiment, the exposure spot 19 of the optical system has a diameter R of 140 μm in the sub-scanning direction. The diameter R of the exposure spot 19 is defined, as shown in FIG. 10, as an area having a quantity of light of more than $1/e^2$ when the maximum quantity of light at the center is 1 in a distribution of quantity of light that decreasing outwardly from the center of exposure spot.

The latent image forming procedure onto the dielectric layer 25 of the image carrying belt 2 by the photosensitive member 9 is basically similar to that of the first embodiment.

Figure 11A:
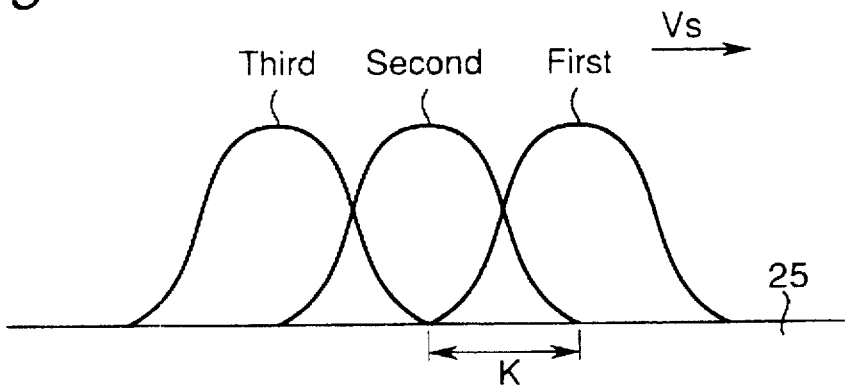
FIG. 11A is a graph showing charge area and charge quantity on the image carrying belt in the case that no shielding layer is provided.
Figure 12:
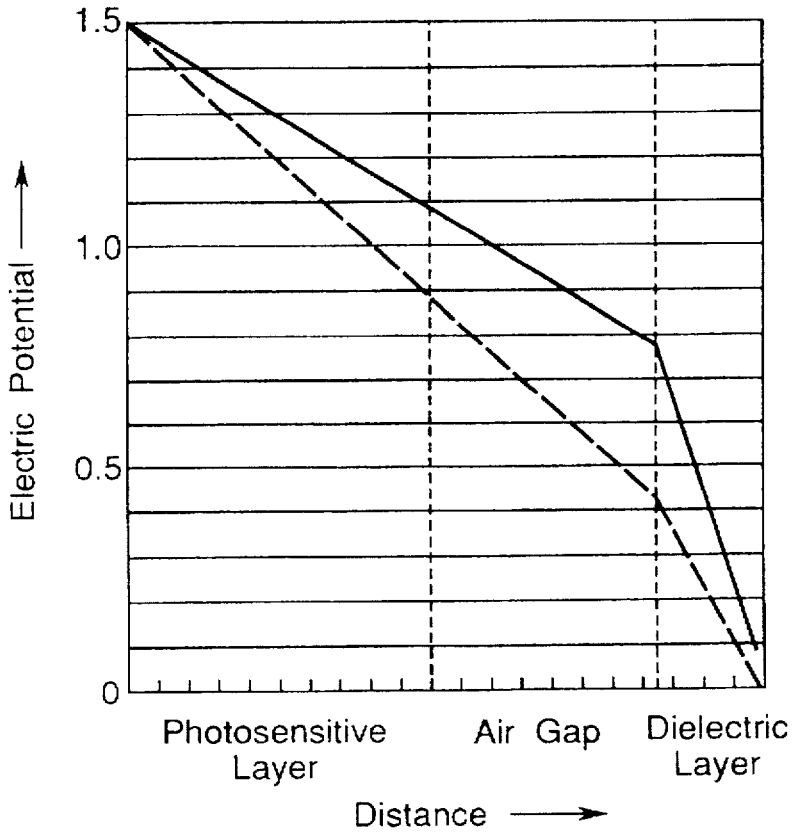
FIG. 12 is a graph showing a distribution of electric potential when applying a voltage to the conductive layer.

Supposing the charged area of the dielectric layer 25 of the image carrying belt 2 by the present (second ) exposure partially overlaps the charged area by the previous (first) exposure in the area K as shown in FIG. 11A, the electric potential of the overlapped area K has already risen. The distribution of the electric potential between the photosensitive member 9 and the image carrying belt 2 is shown in FIG. 12. In FIG. 12, the vertical axis represents the electric potential, the horizontal axis represents the position or distance, and the gradient of the graph represents the intensity of the electric potential. The electric potential distribution when the surface of the dielectric layer 25 is charged is illustrated in a full line while the electric potential distribution when the surface of the dielectric layer 25 is not charged is illustrated in a dashed line.

As clear from FIG. 12, when the surface of the dielectric layer 25 is charged, the electric potential between the transparent conductive layer 92 of the photosensitive member 9 and the dielectric layer 25 of the image carrying belt 2 becomes lower, thereby the gradient of the graph becomes gentler. Thus, the electric field of the air gap between the photosensitive layer 93 and the dielectric layer 25 as well as the electric field formed within the photosensitive layer 93 become lower. As a result, the moving velocity of the carriers generated in the charge generating layer 96 by the present exposure becomes slower, causing a part of carriers to remain undischarged in the photosensitive layer 93 as excess carriers. The excess carriers form a space charge, which causes the elongation of the rear end of the image.

Figure 11B:
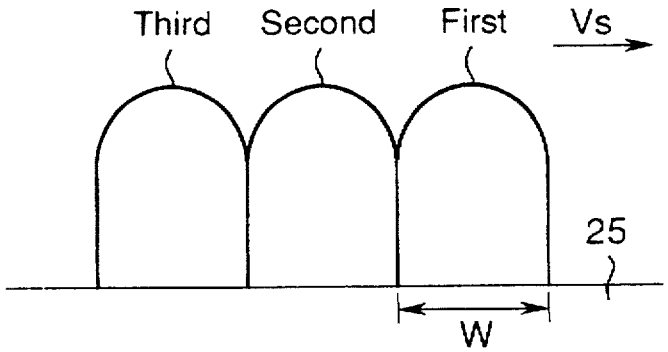
FIG. 11B is a graph showing charge area and charge quantity on the image carrying belt in the case that shielding layer is provided so that the charge area does not overlap.

However, in the second embodiment, since the charge generating layer 96 of the photosensitive member 9 is formed in a belt-like shape extending to the main scanning direction, the area generating carrier pairs is restricted to the area where the charge generating layer 96 exists, no matter how the irradiating area of the laser light beam 83 spreads. Thus, the exposure area of the photosensitive area would be an area which the opposite edges in the sub-scanning direction of the exposure spot 19 of the laser light beam 83 are cut. As a result, as shown in FIG. 11B, the charge distribution in the sub-scanning direction on the dielectric layer 25 of the image carrying belt 2 becomes substantially rectangular in shape, with the both edges cut, i.e., a substantially uniform shape. Therefore, the overlap of the charged areas will disappear, and the generation of the excess carriers will be prevented.

Thus, the belt-like shape of the charge generating layer 96 narrowly extending to the main scanning direction prevents the generation of the excess carriers, whereby the electric discharge is finished synchronously with the completion of exposure, forming a desired latent image substantially the same as the exposure image.

Now will be explained a travel velocity (system velocity) Vs of the image carrying belt 2. In the case of the present second embodiment, the aforementioned effect is remarkably obtained by operating the apparatus in the state that the charged areas in the sub-scanning direction of the dielectric layer 25 do not overlap. To do this end, it is necessary to properly set the travel velocity Vs of the image carrying belt 2. Such travel velocity Vs is a value obtained by dividing the width W of the charged area in the sub-scanning direction by the time interval of exposure, i.e., the time between the first exposure and the second exposure.

Wherein, the width W of the charged area in the sub-scanning direction depends on the width d in the sub-scanning direction of the charge generating layer 96 and the diameter R of the exposure spot 19 of the laser light beam 83.

In the case that the width d in the sub-scanning direction of the charge generating layer 96 is less than the diameter R of the exposure spot 19 of the laser light beam 83, the width W of the charged area in the sub-scanning direction on the dielectric layer 25 due to one main scanning is coincide with the width d of the charge generating layer 96. On the contrary, in the case that the width d in the sub-scanning direction of the charge generating layer 96 is more than the diameter R of the exposure spot 19 of the laser light beam 83, the width W of the charged area in the sub-scanning direction on the dielectric layer 25 due to one main scanning can be considered to be the diameter R of the exposure spot 19 of the laser light beam 83.

In addition, in the apparatus in which the travel velocity Vs of the image carrying belt 2 is predetermined, it is preferable to calculate a charged width (a width of charged area in the sub-scanning direction charged by one main scanning) from the product of the travel velocity Vs by the time interval of exposure, and then determine a proper value of the width d in the sub-scanning direction of the charge generating layer 96.

Specifically, when the time interval of exposure of the laser light beam 83 is 2.24 ms (characteristic value to be decided by the laser scanning velocity), the width d in the sub-scanning direction of the charge generating layer 96 is 90 μm, and the diameter R of the exposure spot 19 of the laser light beam 83 is 140 μm, the width d in the sub-scanning direction of the charge generating layer 96 becomes to 90 μm. Then, the travel velocity (system velocity) Vs of the image carrying belt 2 is 40 mm/s $[=(90\times10^{-6})/(2.24\times10^{-3})]$.

As the photosensitive member of the aforementioned second embodiment, one manufactured by the following method.

First, a base member was made by forming the ITO film 94 on the transparent substrate 91 and coating the polyamide resin layer 95 thereon to form the conductive layer 92 in the same manner as the aforementioned first embodiment.

Subsequently, the belt-like charge generating layer 96 extending to the main scanning direction as shown in FIG. 8 was provided on the conducive layer 92 by coating the photosensitive paint same as that of the aforementioned first embodiment by the dipping method so that a film thickness after drying becomes to 0.15 μm. The charge generating layer 96 was formed in a state in which a mask sheet is tightly fit on the surface of the conductive layer 92 and thereafter removing the mask. Alternatively, the charge generating layer 96 may be provided by vapor depositing the photosensitive paint on the base with the mask fit.

Then, on the surface of the base and the charge generating layer 96, the charge transporting layer 97 was formed in the same manner as the aforementioned first embodiment.

A concrete experiment performed for confirming the effect of the image forming apparatus of the second embodiment will be described next. The experimental was performed in the same basic condition as that of the aforementioned first embodiment.

The conditions of the experimental examples and the comparative examples and experiment results are shown in Table 2.

In the experimental examples 1 through 5, the diameter R of exposure spot 19 of the laser light beam 83 was 140 μm, and the width d in the sub-scanning direction of the charge generating layer 96 was changed. Next, in the experimental examples 6 through 10, the diameter R of exposure spot 19 of the laser light beam 83 was 200 μm, and the width d in the sub-scanning direction of the charge generating layer 96 was changed in the same manner as the experimental examples 1 through 5. Further, ones each having plane charge generating layer on the full surface of the conductive layer were used as comparative examples, in which the diameter R of exposure spot 19 of the laser light beam 83 was 140 μm and 200 μm, and the system velocity Vs was changed.

The measurements and the evaluations were made in the same manner as that in the aforementioned first embodiment. It is to be noted that one in which line image includes disconnection or blur and causes a problem on practical use was marked with "*".

TABLE 2

| | CGL | d (μm) | R (μm) | Vs (mm/s) | Evaluation |
|---|---|---|---|---|---|
| Exp. ex. 1 | Belt-like | 50 | 140 | 22.5 | ○ |
| ex. 2 | Belt-like | 90 | 140 | 40 | ○ |
| ex. 3 | Belt-like | 130 | 140 | 58 | ○ |
| ex. 4 | Belt-like | 170 | 140 | 62.5 | ◇ |
| ex. 5 | Belt-like | 210 | 140 | 62.5 | △ |
| ex. 6 | Belt-like | 50 | 200 | 22.5 | ◎ |
| ex. 7 | Belt-like | 90 | 200 | 40 | ◎ |
| ex. 8 | Belt-like | 130 | 200 | 58 | ○ |
| ex. 9 | Belt-like | 170 | 200 | 76 | ○ |
| ex. 10 | Belt-like | 210 | 200 | 89 | △ |
| Com. ex. 1 | Full | | 140 | 53.5 | x |
| ex. 2 | Full | | 140 | 62.5 | x |
| ex. 3 | Full | | 140 | 71.5 | *x |
| ex. 4 | Full | | 140 | 80.5 | *○ |
| ex. 5 | Full | | 200 | 80.5 | x |
| ex. 6 | Full | | 200 | 89 | x |
| ex. 7 | Full | | 200 | 98 | *x |
| ex. 8 | Full | | 200 | 107 | *◇ |

According to the result of the experimental examples 1 through 10 and the comparative examples 1 through 8, it is clear that the examples having the belt-like charge generating layer 96 extending in the main scanning direction were remarkably improved in the elongation of the rear edge of the image in comparison with the examples having the flat charge generating layer provided on the full surface of the conductive layer. In addition, it is considered effective to eliminate the elongation of the image that the width d in the sub-scanning direction of the charge generating layer 96 is set smaller than the diameter R of exposure spot 19 of the laser light beam 83.

Figure 13:
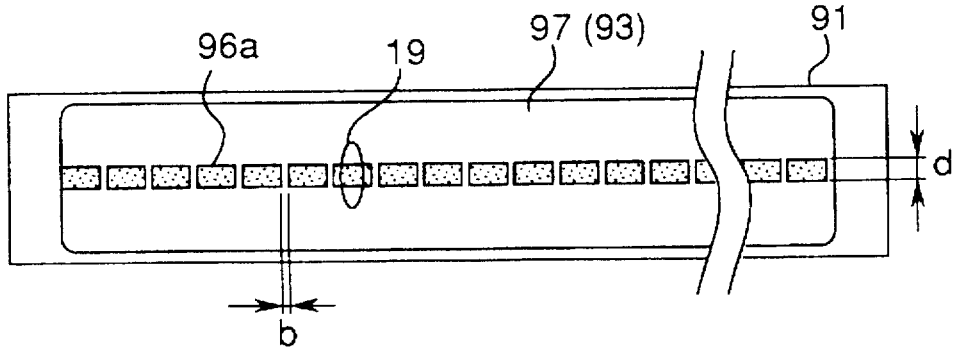
FIG. 13 is a view showing a pattern shape of the charge generating layer of another variation of FIG. 9.

FIG. 13 shows a variation of the charge generating layer of the second embodiment. In FIG. 13, the belt-like shape of the charge generating layer 98 is formed discontinuously with gaps "b". The gaps "b" of the discontinuous charge generating layer 98 can be within a range that the gaps do not affect the image formed on the image carrying belt 2. According to such construction, there is an advantage that the charge is prevented from transversely flowing in the main scanning direction, enabling to obtain more sharp image.

In the case of the aforementioned construction provided with the belt-like charge generating layer 96, without constructing the optical system highly minutely, it is possible to raise the picture element density in the sub-scanning direction by narrowly forming the width in the sub-scanning direction of the charge generating layer 96 and properly setting the system velocity Vs, enabling to form a highly clear image, and enabling to attain the high clearization in a low price.

In addition, in the case that the width of the charge generating layer 96 is sufficiently narrow as compared with the diameter of exposure spot, especially in the case of exposure by laser light beam, without correcting a deflection of the laser light beam, the charge generating layer 96 is exposed by only a part of exposure spot of the laser light beam to generate carrier pairs. Thus, the latent image formed on the image carrying belt does not deflect synchronously with the deflection of the laser light beam.

Third Embodiment

Figure 14:
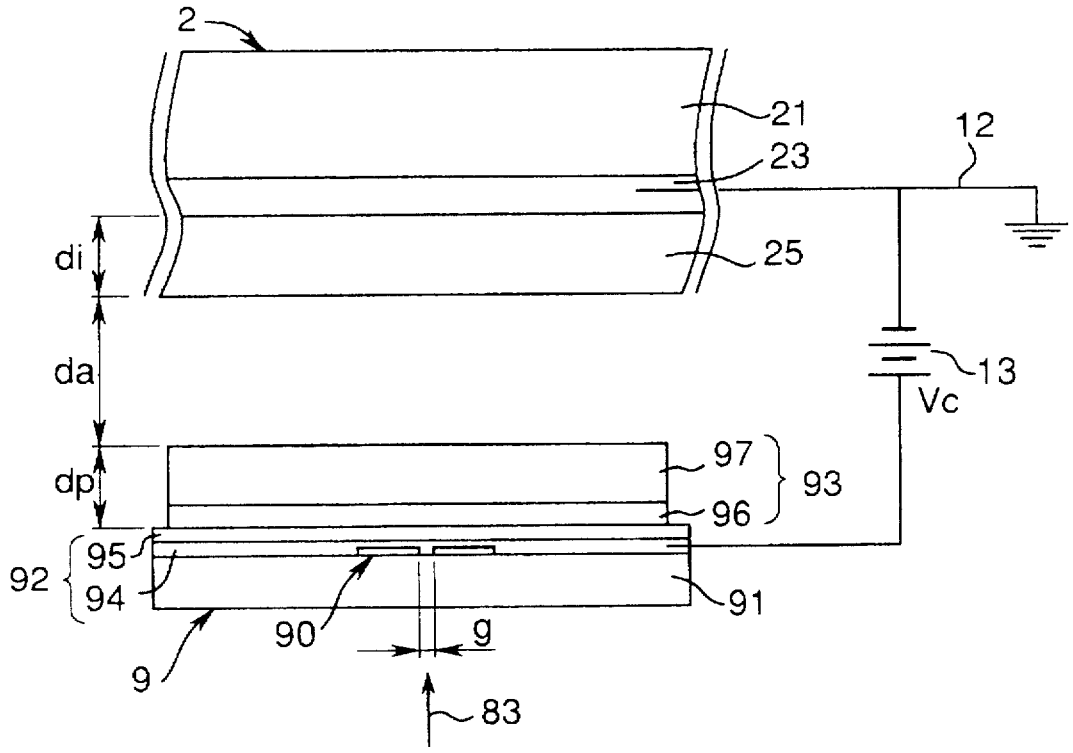
FIG. 14 an enlarged sectional view of a portion of the image forming apparatus according to a third embodiment of the present invention.
Figure 15:
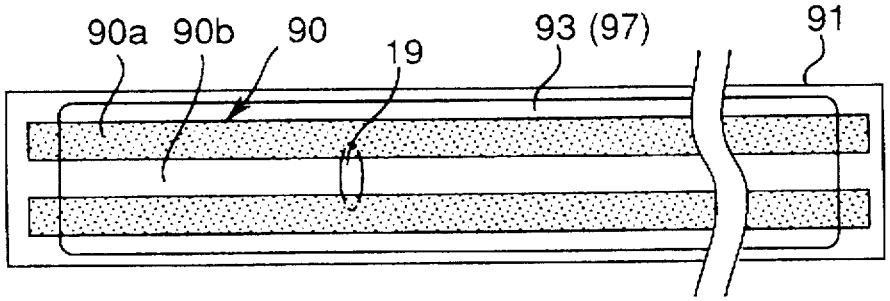
FIG. 15 is a view showing a pattern shape of the shielding layer of the photosensitive member.

FIG. 14 shows a third embodiment of photosensitive member 9 of the image forming apparatus according to the present invention. The photosensitive member 9 is similar to the photosensitive member 9 in FIG. 2 except that there is no surface electrode layer on the photosensitive layer 93 and that a shield layer 90 are provided on transparent substrate 91.

The shield layer 90 shielding a portion of the laser light beam 83 irradiated from the light source comprises two belt-like shield portions 90*a* perpendicular to each other. The shield portions 90*a* are made of chromium coating and disposed in the main scanning direction. Between the shield portions 90*a*, the shield layer 90 includes a slit 90*b* having a width of 90 μm through which the laser light beam 83 passes.

In this third embodiment, the opposite edges in the sub-scanning direction of the exposure spot 19 of the laser light beam 83 are shielded by the shield portions 90*a* of the shield layer 90. As a result, as shown in FIG. 11B, the charge distribution in the sub-scanning direction on the dielectric layer 25 of the image carrying belt 2 becomes to a substantially rectangular shape with the both edges cut, i.e., a substantially uniform shape. Therefore, the overlap of the charged areas will disappeared, and the generation of the excess carriers will be prevented.

Thus, the belt-like shape of the shield layer 90 enables to prevent the generation of the excess carriers, whereby the electric discharge is finished synchronously with the completion of exposure, allowing to form a desired latent image substantially same as the exposure image.

As the photosensitive member of the aforementioned third embodiment, one manufactured by the following method.

First, a base member was made by forming a slit pattern of shield layer 90 on the transparent substrate 91, forming the ITO film 94 thereon and coating the polyamide resin layer 95 thereon to form the conductive layer 92 in the same manner as the aforementioned first embodiment.

The shield layer 90 was formed by vapor depositing chromium on the transparent substrate 91 to form a chromium coating having a thickness of 0.2 μm and then applying a photo-lithographic process to the chromium coating to form a slit 90*b*. The shield layer may have a uniform thickness within the range that shielding characteristic is not prevented and that durability is maintained in a practical use.

Subsequently, the charge generating layer 96 was provided on the conducive layer 92 by coating the photosensitive paint same as that of the aforementioned first embodiment by the dipping method so that a film thickness after drying becomes to 0.4 μm.

Then, on the surface of the charge generating layer 96, the charge transporting layer 97 was formed in the same manner as the aforementioned first embodiment.

Besides chromium coating, the shield layer 90 may be made of metal thin coating such as aluminum, titanium, magnesium, gold, or platinum, colored resin, paint, or ink, or so.

Alternatively, the shield layer 90 may be formed by a method of vapor depositing or splaying utilizing the mask sheet, screen print, or making a slit pattern by laser processing after forming a thin coating.

A concrete experiment performed for confirming the effect of the image forming apparatus of the third embodiment will be described next. The experimental was performed in the same basic condition as that of the aforementioned first embodiment.

The conditions of the experimental examples and the comparative examples and experiment results are shown in Table 3.

In the experimental examples 1 through 5, the diameter R of exposure spot 19 of the laser light beam 83 was 140 μm, and the slit width (the distance between the belt-like shield portions) g of the shield layer 90 was changed. Next, in the experimental examples 6 through 10, the diameter R of exposure spot 19 of the laser light beam 83 was 200 μm, and the slit width was changed in the same manner as the experimental examples 1 through 5. Further, ones each having no shield layer were used as comparative examples, in which the diameter R of exposure spot 19 of the laser light beam 83 was 140 μm and 200 μm, and the system velocity Vs was changed.

The measurements and the evaluations were made in the same manner as that in the aforementioned first embodiment.

TABLE 3

| | Sield layer | g (μm) | R (μm). | Vs (mm/s) | Evaluation |
|---|---|---|---|---|---|
| Exp. ex. 1 | yes | 50 | 140 | 22.5 | ⊙ |
| ex. 2 | yes | 90 | 140 | 40 | ○ |
| ex. 3 | yes | 130 | 140 | 58 | ○ |
| ex. 4 | yes | 170 | 140 | 62.5 | ◇ |
| ex. 5 | yes | 210 | 140 | 62.5 | △ |
| ex. 6 | yes | 50 | 200 | 22.5 | ⊙ |
| ex. 7 | yes | 90 | 200 | 40 | ○ |
| ex. 8 | yes | 130 | 200 | 58 | ⊙ |
| ex. 9 | yes | 170 | 200 | 76 | ○ |
| ex. 10 | yes | 210 | 200 | 89 | ◇ |
| Com. ex. 1 | none | | 140 | 53.5 | x |
| ex. 2 | none | | 140 | 62.5 | x |
| ex. 3 | none | | 140 | 71.5 | *x |
| ex. 4 | none | | 140 | 80.5 | *○ |
| ex. 5 | none | | 200 | 80.5 | x |
| ex. 6 | none | | 200 | 89 | x |
| ex. 7 | none | | 200 | 98 | *x |
| ex. 8 | none | | 200 | 107 | *◇ |

According to the result of the experimental examples 1 through 10 and the comparative examples 1 through 8, it is clear that the examples having the shield layer 90 were remarkably improved in the elongation of the rear edge of the image in comparison with the examples having no shield layer. In addition, it is considered effective to eliminate the elongation of the image that the slit width g of the shield layer 90 is set smaller than the diameter R of exposure spot 19 of the laser light beam 83. Moreover, it is considered to be preferable that the slit width g is to be 0.2 to 0.9 times the diameter R of exposure spot.

Figure 16:
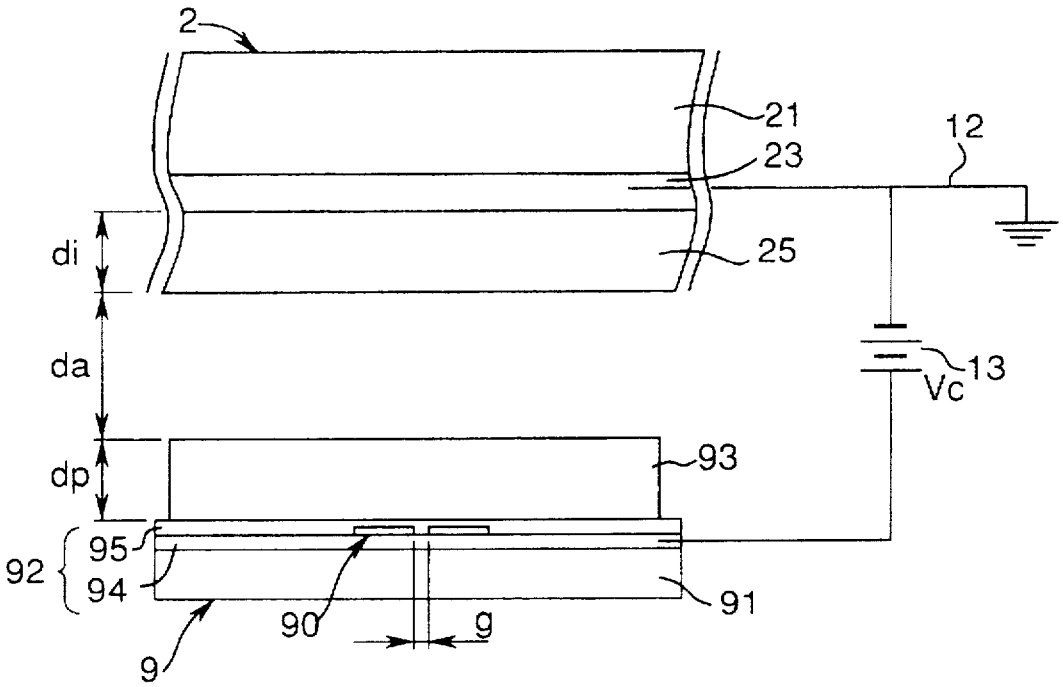
FIG. 16 is an enlarged sectional view of the photosensitive member and the image carrying member of another variation FIG. 14.
Figure 17:
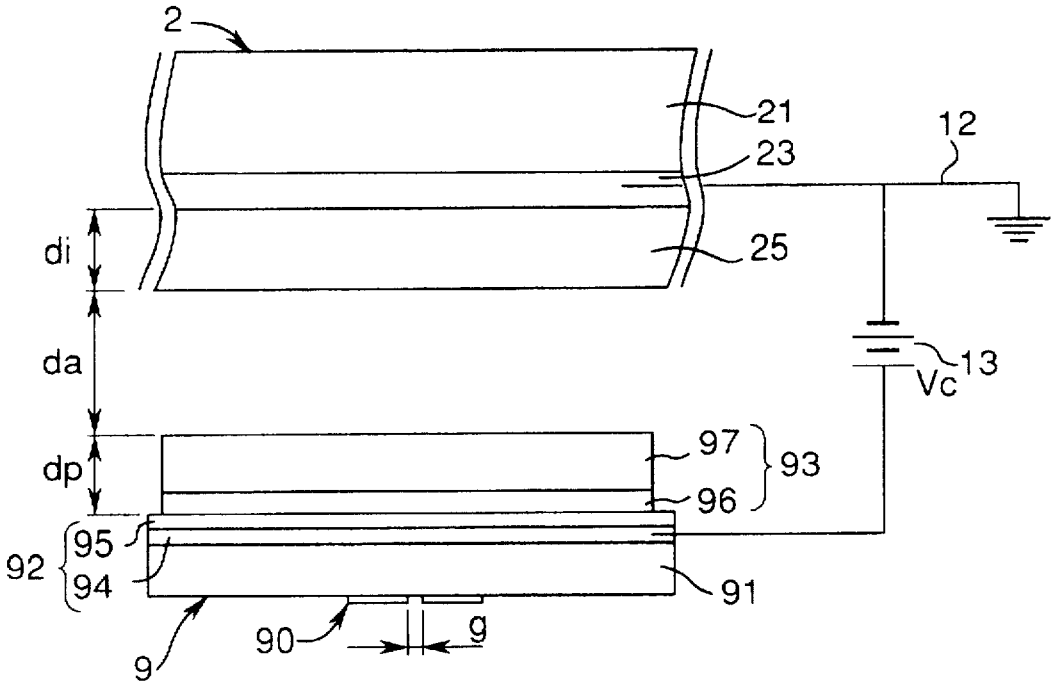
FIG. 17 is an enlarged sectional view of the photosensitive member and the image carrying member of another variation of FIG. 14.
Figure 18:
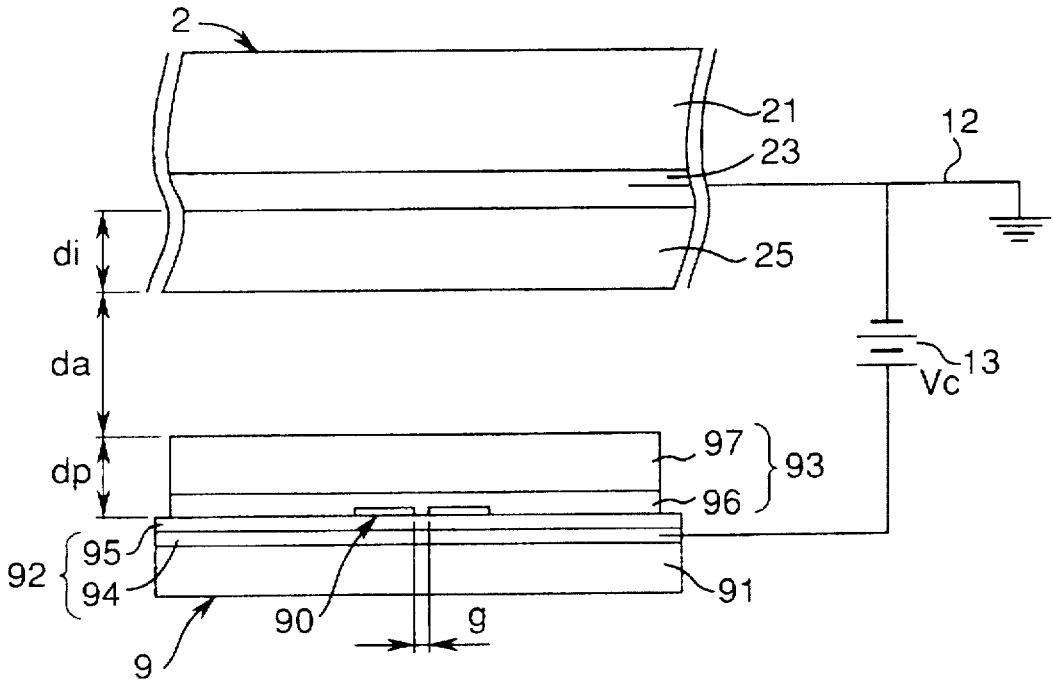
FIG. 18 is an enlarged sectional view of the photosensitive member and the image carrying member of another variation of FIG. 14.
Figure 19:
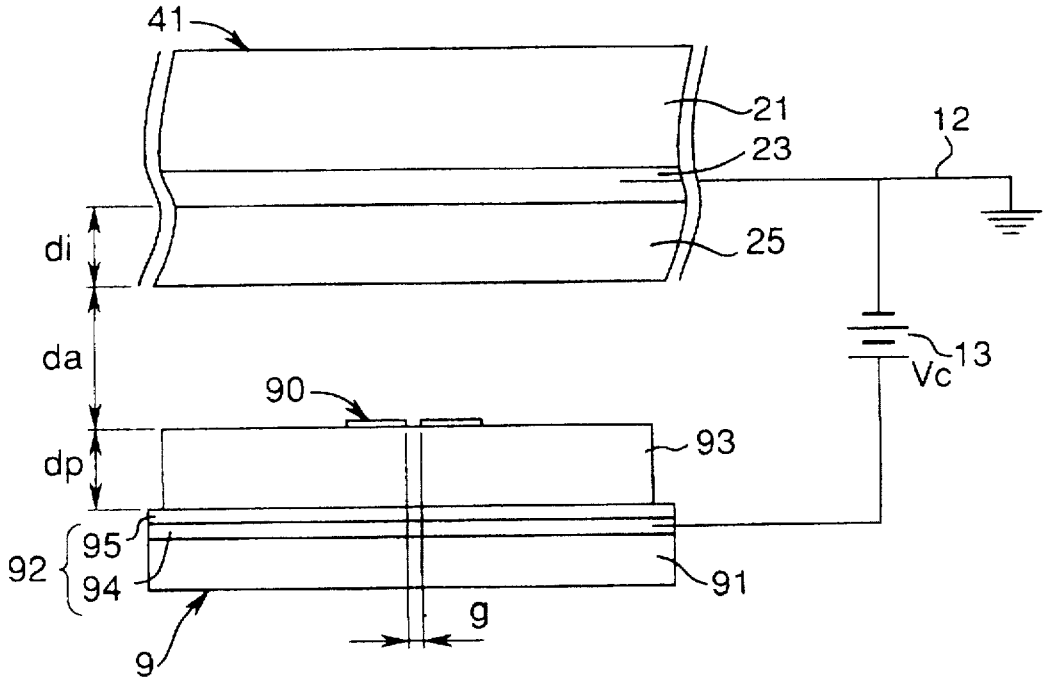
FIG. 19 is an enlarged sectional view of the photosensitive member and the image carrying member of another variation of FIG. 14.

FIGS. 16 to 18 show variations of the shield layer 90 of the second embodiment.

The shield layer 90 shown in FIG. 16 is formed on the ITO film 94. This construction has an advantage that the shield layer 90 needs not endure the substrate heating temperature (several hundred degrees) at the time of forming the ITO film 94, which widens the selection range of material of the shield layer 90 on the aspect of heat resistance. The variation in FIG. 16 utilizes a single layer type of photosensitive layer 93.

The shield layer 90 shown in FIG. 17 is formed on the surface of the transparent substrate 91 at the side of incidence plane of the laser light beam 83. This construction has an advantage that fabrication of the photosensitive member becomes easier and adjustment of the relation between the irradiation position of the laser light beam 83 and the position of the shield layer also becomes easier.

The shield layer 90 shown in FIG. 18 is disposed between the polyamide resin layer 95 and the charge generating layer 96 of the photosensitive layer 93. This construction has advantages that since the shield layer is closed contact with the charge generating layer, there is no decrease in the effect of the present invention due to scattering of light, and that the selection range of material of the shield layer 90 widens similarly to the variation in FIG. 16.

Fourth Embodiment

Figure 20:
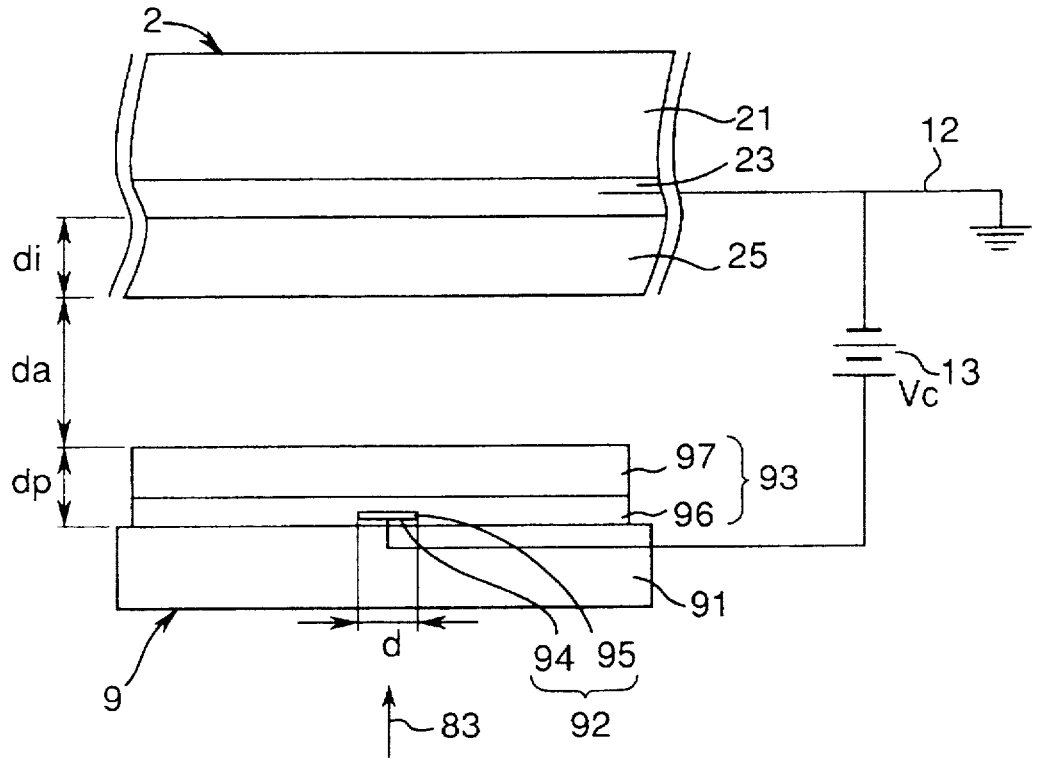
FIG. 20 is an enlarged sectional view of a portion of the image forming apparatus according to a fourth embodiment of the present invention.

FIG. 20 shows a fourth embodiment of photosensitive member 9 of the image forming apparatus according to the present invention. The photosensitive member 9 is similar to the photosensitive member 9 in FIG. 2 except that there is no surface electrode layer on the photosensitive layer 93 and that the conductive layer 92 is formed in a belt-like shape.

Figure 21:
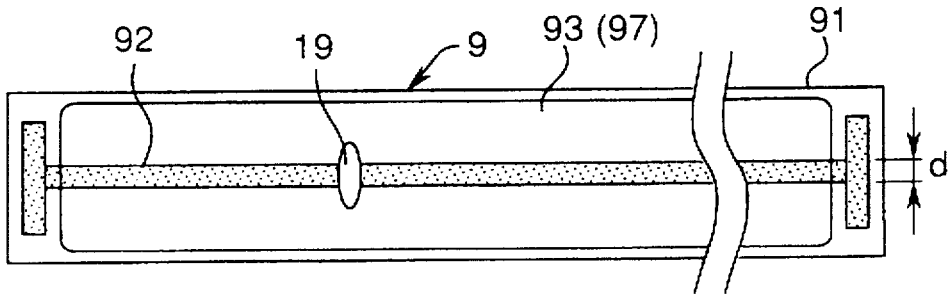
FIG. 21 a view showing a pattern shape of the conducting layer of the photosensitive member.

The belt-like conductive layer 92 comprises the ITO film 94 and the polyamide resin layer 95 similarly to the aforementioned embodiment. The belt-like conductive layer 92, as shown in FIG. 21, has a width d of 90 μm in S the sub-scanning direction and extends to the main scanning direction.

In the fourth embodiment, since the conductive layer 92 of the photosensitive member 9 is formed in a belt-like shape extending to the main scanning direction, the area in which electric field is formed, i.e., the area in which the carriers moves is restricted. In an area where the laser light beam 83 is irradiated, carriers are generated. In an area, within the irradiated area, where the electric field is not formed, the carriers is instantaneously coupled again to disappear. On the other hand, in an area where the electric field is formed, the carriers are transported within the photosensitive layer 93 by virtue of the electric field and discharged within the area where the electric field is formed. As a result, it seems as if the carriers were generated only within the area where the electric field was formed. Thus, as shown in FIG. 11B, the charge distribution in the sub-scanning direction on the dielectric layer 25 of the image carrying belt 2 becomes to a substantially rectangular shape with the both edges cut, i.e., a substantially uniform shape. Therefore, the overlap of the charged areas will disappeared, and the generation of the excess carriers will be prevented.

Thus, the belt-like shape of the shield layer 90 enables to prevent the generation of the excess carriers, whereby the electric discharge is finished synchronously with the completion of exposure, allowing to form a desired latent image substantially same as the exposure image.

As the photosensitive member of the aforementioned fourth embodiment, one manufactured by the following method.

First, a base member was made by forming the belt-like conductive layer 92 extending to the main scanning direction as shown in FIG. 21 on the transparent substrate 91. The belt-like conductive layer 92 was formed by tightly fitting a mask with belt-like slit on the surface of the transparent substrate 91, forming the ITO film 94 on the transparent substrate 91 and coating the polyamide resin layer 95 thereon in the same manner as the aforementioned first embodiment, and thereafter removing the mask.

Subsequently, the charge generating layer 96 was provided on the conducive layer 92 and the transparent substrate 91 by coating the photosensitive paint same as that of the aforementioned first embodiment by the dipping method so that a film thickness after drying becomes to 0.4 μm.

Then, on the surface of the charge generating layer 96, the charge transporting layer 97 was formed in the same manner as the aforementioned first embodiment.

Alternatively, the belt-like conductive layer 92 may be formed by applying a photo-lithography processing to the conductive layer to make a slit, or by printing utilizing a conductive ink.

A concrete experiment performed for confirming the effect of the image forming apparatus of the fourth embodiment will be described next. The experimental was performed in the same basic condition as that of the aforementioned first embodiment.

The conditions of the experimental examples and the comparative examples and experiment results are shown in Table 4.

In the experimental examples 1 through 5, the diameter R of exposure spot 19 of the laser light beam 83 was 140 μm, and the width d of the belt-like conductive layer 92 was changed. Next, in the experimental examples 6 through 10, the diameter R of exposure spot 19 of the laser light beam 83 was 200 μm, and the width d the belt-like conductive layer 92 was changed in the same manner as the experimental examples 1 through 5. Further, ones each having the plane conductive layer on the full surface of the substrate were used as comparative examples, in which the diameter R of exposure spot 19 of the laser light beam 83 was 140 μm and 200 μm, and the system velocity Vs was changed.

The measurements and the evaluations were made in the same manner as that in the aforementioned first embodiment.

TABLE 4

| | Electrode | d (μm) | R (μm) | Vs (mm/s) | Evaluation |
|---|---|---|---|---|---|
| Exp. ex. 1 | Belt-like | 50 | 140 | 22.5 | ⊙ |
| ex. 2 | Belt-like | 90 | 140 | 40 | ○ |
| ex. 3 | Belt-like | 130 | 140 | 58 | ○ |
| ex. 4 | Belt-like | 170 | 140 | 62.5 | ◇ |
| ex. 5 | Belt-like | 210 | 140 | 62.5 | Δ |
| ex. 6 | Belt-like | 50 | 200 | 22.5 | ○ |
| ex. 7 | Belt-like | 90 | 200 | 40 | ○ |
| ex. 8 | Belt-like | 130 | 200 | 58 | ○ |
| ex. 9 | Belt-like | 170 | 200 | 76 | ○ |

TABLE 4-continued

| | Electrode | d (μm) | R (μm) | Vs (mm/s) | Evaluation |
|---|---|---|---|---|---|
| ex. 10 | Belt-like | 210 | 200 | 89 | Δ |
| Com. ex. 1 | Full | | 140 | 53.5 | x |
| ex. 2 | Full | | 140 | 62.5 | x |
| ex. 3 | Full | | 140 | 71.5 | *x |
| ex. 4 | Full | | 140 | 80.5 | *○ |
| ex. 5 | Full | | 200 | 80.5 | x |
| ex. 6 | Full | | 200 | 89 | x |
| ex. 7 | Full | | 200 | 98 | *x |
| ex. 8 | Full | | 200 | 107 | *◇ |

According to the result of the experimental examples 1 through 10 and the comparative examples 1 through 8, it is clear that the examples having the belt-like conductive layer 92 were remarkably improved in the elongation of the rear edge of the image in comparison with the examples having the flat conductive layer provided on the full surface of the substrate. In addition, it is considered effective to eliminate the elongation of the image that the slit width g of the shield layer 90 is set smaller than the diameter R of exposure spot 19 of the laser light beam 83.

Figure 22:
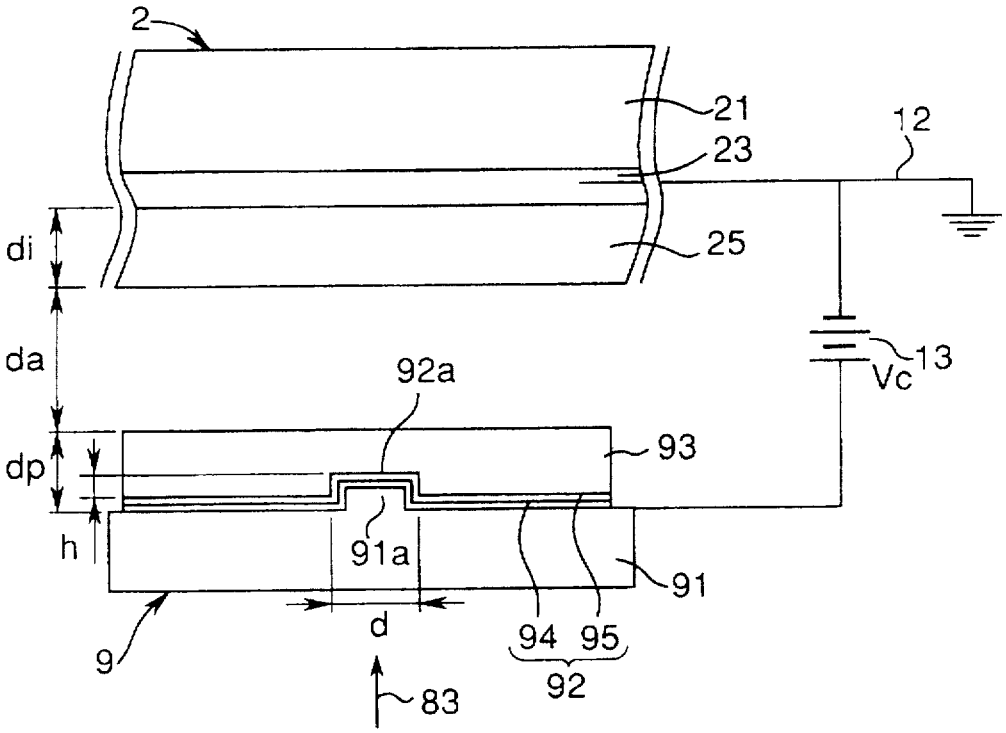
FIG. 22 is an enlarged sectional view of the photosensitive member and the image carrying member of another variation of FIG. 20.

FIG. 22 shows a variation of the photosensitive member of the fourth embodiment.

The photosensitive member is formed by forming the ITO film 94 on the transparent substrate 91 with a belt-like shape of projection and coating the polyamide resin layer 95 thereon to form the conductive layer 92, and forming the single layer type of the photosensitive layer 93 in the same manner as the aforementioned first embodiment.

The belt-like shape of projection **91*a* provided on the transparent substrate 91 has a width in the sub-scanning direction of 90 μm and a height of 5 μm. The existence of the projection 91*a* on the transparent substrate 91 provides a projection 92*a* on surface of the conductive layer 92**.

In the variation shown in FIG. 22, since the conductive layer 92 is provided with the projection **92*a*, the electric field concentrates on the projection 92*a* which is closest to the conductive layer 23 of the image carrying belt. Thus, as shown in FIG. 11B, the charge distribution in the sub-scanning direction on the dielectric layer 25 of the image carrying belt 2** becomes to a substantially rectangular shape with the both edges cut, i.e., a substantially uniform shape. Therefore, the overlap of the charged areas will disappeared, and the generation of the excess carriers will be prevented.

Thus, the belt-like shape of projection **92*a* formed on the conductive layer 92** enables to prevent the generation of the excess carriers, whereby the electric discharge is finished synchronously with the completion of exposure, allowing to form a desired latent image substantially same as the exposure image.

In order to confirm the effect of the belt-like projection **92*a* on the conductive layer 92**, an experiment was performed. The conditions of the experimental examples and the comparative examples and experiment results are shown in Table 5.

In the experimental examples 11 through 15, the diameter R of exposure spot 19 of the laser light beam 83 was 140 μm, the width d of the belt-like projection **92*a* on the conductive layer 92 was 90 μm, and the height h of the projection 92*a* was changed. Next, in the experimental examples 16 through 19, the diameter R of exposure spot 19 of the laser light beam 83 was 140 μm, the height h of the projection 92*a* was 5 μm, the width d the belt-like projection 92*a* was changed, and the system velocity Vs was changed in accordance with the charged width in the sub-scanning direction on the dielectric layer 25** (i.e., the width d of the projection or the diameter R of the exposure spot).

The measurements and the evaluations were made in the same manner as that in the aforementioned first embodiment.

TABLE 5

| | Projection | d (μm) | h (μm) | R (μm) | Vs (mm/s) | Evaluation |
|---|---|---|---|---|---|---|
| Exp. ex. 11 | Belt-like | 90 | 0.5 | 140 | 40 | Δ |
| ex. 12 | Belt-like | 90 | 1 | 140 | 40 | Δ |
| ex. 13 | Belt-like | 90 | 2 | 140 | 40 | ◇ |
| ex. 14 | Belt-like | 90 | 3 | 140 | 40 | ○ |
| ex. 15 | Belt-like | 90 | 5 | 140 | 40 | ○ |
| ex. 16 | Belt-like | 50 | 5 | 140 | 22.5 | ○ |
| ex. 17 | Belt-like | 130 | 5 | 140 | 58 | ○ |
| ex. 18 | Belt-like | 170 | 5 | 140 | 62.5 | Δ |
| ex. 19 | Belt-like | 210 | 5 | 140 | 62.5 | Δ |

According to the result of the experimental examples 11 through 19, it is clear that the examples having the belt-like projection 92*a* on the conductive layer 92 were remarkably improved in the elongation of the rear edge of the image in comparison with the examples of Table 4. According to the experimental examples 11 through 15, it is preferable that the height h of the belt-like projection 92*a* is more than 3 μm. In addition, it is considered effective to eliminate the elongation of the image that the width d of the belt-like projection 92*a* is set smaller than the diameter R of exposure spot 19 of the laser light beam 83.

Figure 23:
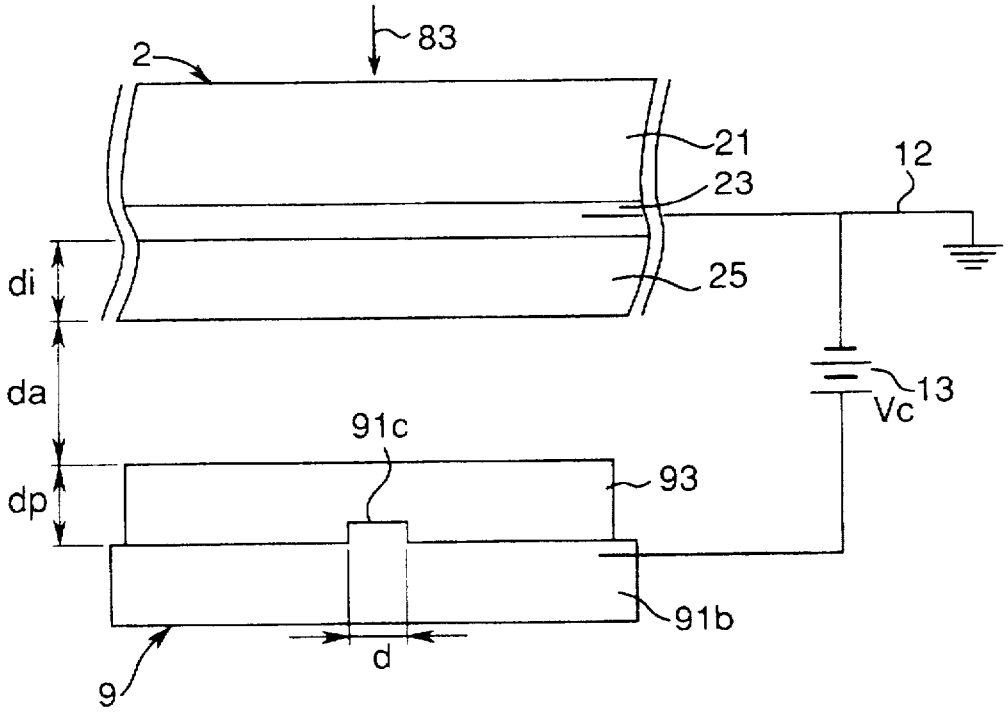
FIG. 23 is an enlarged sectional view of the photosensitive member and the image carrying member of another variation FIG. 20.

FIG. 23 shows an another variation of the photosensitive member of the fourth embodiment. In the variation in FIG. 23, the laser light beam is irradiated from the side of the image carrying belt 2 as described hereinafter. The substrate 91*a* is made of conductive material such as aluminum and serves as both a support member and a conductive layer. The conductive substrate 91*b* is provided with a belt-like projection 91*c* extending to the main scanning direction. In the variation in FIG. 23, the single layer type of the photosensitive layer 93 is used.

The belt-like projection 91*c* of the conductive substrate 91*b* causes the electric field formed within the photosensitive layer 93 to concentrate on the belt-like projection 91*c*. Thus, in the same manner as aforementioned embodiment, the carriers is generated in response to only a part of the laser light beam 83 irradiated on the concentrated area of the electric field, which prevents the overlap of charged area and eliminates the elongation of the rear end of the latent image.

The conductive substrate 91*b* may be made of any metallic material having electric conductivity, preferably one having a volume resistivity of less than $10^7$ Ω. It is not limited to form the projection 91*c* integrally with the conductive substrate 91*b*. The projection 91*c* may be formed or added on the conductive substrate 91*b* by an electroforcing method or any other known method.

The projections 92*a* and 91*c* in the aforementioned variations need not to be continuous to the main scanning direction and may be discontinuity within a range that it does not affect the image formed on the image carrying belt 2.

In the case of the aforementioned construction in which the electric field formed within the photosensitive layer 93 concentrates on the belt-like portion extending to the main scanning direction, without constructing the optical system highly minutely, it is possible to raise the picture element density in the sub-scanning direction by narrowly forming the width in the sub-scanning direction of the belt-like portion where electric field is formed and properly setting the system velocity Vs, enabling to form a highly clear image, and enabling to attain the high clearization in a low price. In addition, since the electric field concentrates on the specific portion, the quantity of charge due to the discharge increases, which results in high contrast image.

Other Embodiment

Figure 24:
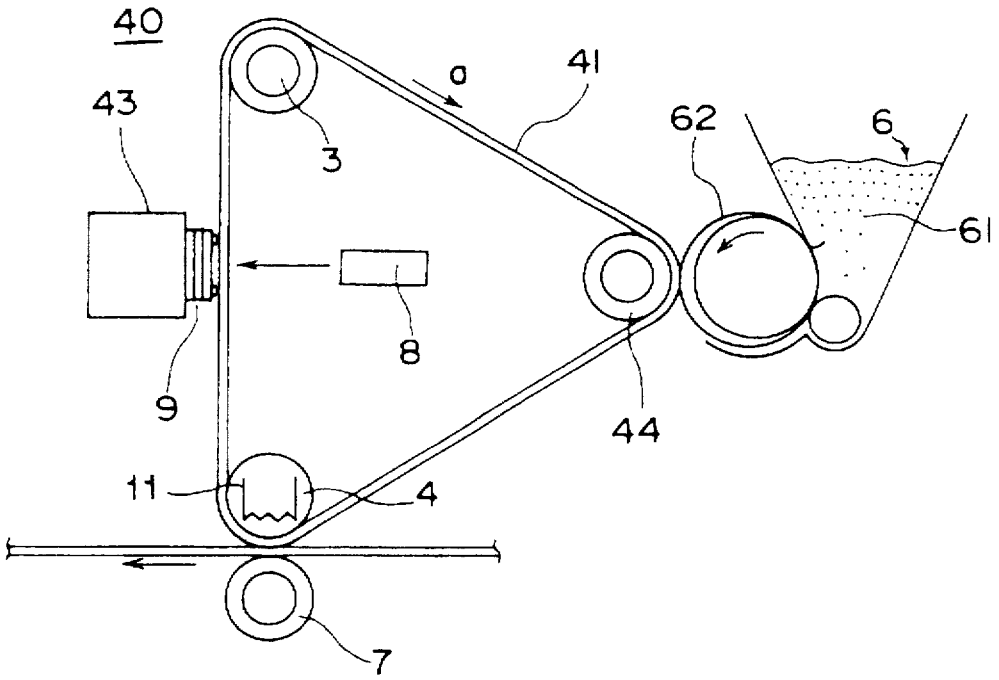
FIG. 24 is a sectional view of the image forming apparatus of according to another embodiment of the present invention.
Figure 25:
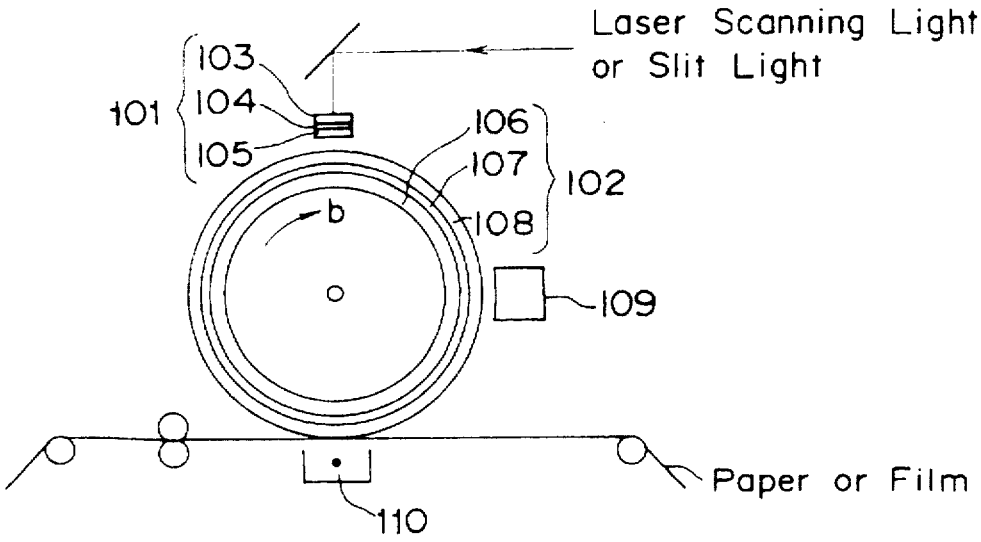
Fig. 25 PRIOR ART
FIG. 25 is a sectional view of an image forming apparatus of prior art.
Figure 26B:
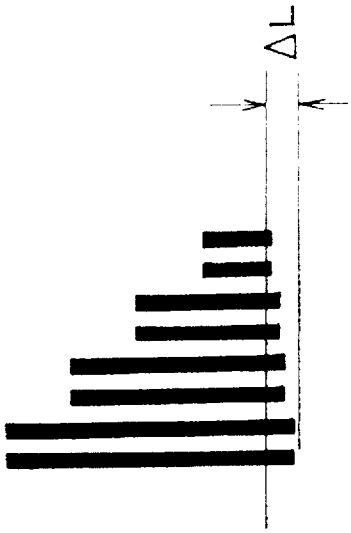
FIG. 26B is a graph showing a toner image of the test pattern of FIG. 26A by utilizing the image forming apparatus of prior art.
Figure 26A:
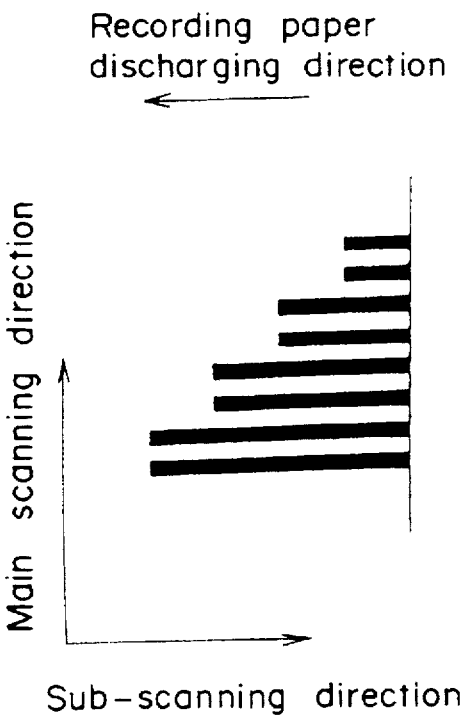
FIG. 26A is graph showing a test pattern of document image.

FIG. 24 shows an image forming apparatus according to another embodiment which performs exposure from the front surface side of the photosensitive layer 93.

In this image forming apparatus 40, the optical system 8 is arranged inside an image carrying belt 41, and the laser light application direction is arranged so that the laser light is applied from the front surface side of the photosensitive layer 93 (from the opposite surface side of the image carrying belt 41). Therefore, it is required to form the image carrying belt 41 so that it has a transparency.

On the other hand, conversely, a support body 43 for supporting the photosensitive layer 93 of the photosensitive member 9 and the conductive layer 92 of the photosensitive member 9 are not required to have a transparency. In addition, it is required to provide a large space inside the belt for the purpose of placing the optical system 8 inside the image carrying belt 41, and therefore, an auxiliary roller 44 is provided. The other portions have constructions equivalent to those of the aforementioned embodiment, and therefore, they are denoted by the same reference numerals with no description provided therefor.

Even with the above arrangement, by providing the photosensitive member 9 of any one of the aforementioned embodiments, the elongation of the image (elongation at the image rear end portion of the latent image) can be effectively managed.

Although the semiconductor laser is used as a light source for exposing the photosensitive member 9 to light in either one of the aforementioned embodiments, the present invention is not limited to this, and a known exposure method such as an LED system, an LCD shutter system or a PLZT system can be used so long as it can appropriately expose the photosensitive member 9 to light Furthermore, it is a matter of course that an unexposed portion can be developed without developing an exposed portion by changing the characteristics of the developer and the like.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. An image forming apparatus, comprising:

an image carrying member having an insulating layer formed on a first conductive layer;

a photosensitive member having a photosensitive layer formed on a second conductive layer, the photosensitive member being supported so that the photosensitive layer is opposed to the insulating layer of the image carrying member;

a first voltage applying means for applying a voltage between the first conductive layer and the second conductive layer;

a pattern-like surface electrode layer formed on the surface of the photosensitive layer opposed to the image carrying member;

a second voltage applying means for applying a bias voltage to the surface electrode layer; and an exposure means for exposing the photosensitive member to generate a charge in the photosensitive member that discharges between the pattern-like surface electrode layer and the image carrying member, thereby forming an electrostatic latent image on the surface of the image carrying member.

2. The image forming apparatus as in claim 1, wherein the pattern-like surface electrode layer is coated with an insulating protection layer.

3. The image forming apparatus as in claim 1, wherein the pattern of the pattern-like surface electrode layer is a shape having at least one slit.

4. The image forming apparatus as in claim 1, wherein the pattern of the pattern-like surface electrode layer is a mesh.

5. The image forming apparatus as in claim 3, wherein the slit of the pattern-like surface electrode layer has a width of 10 to 150 microns, and wherein the conductive portion which form the slit has a width of 2 to 50 microns.

6. The image forming apparatus as in claim 3, wherein the pattern-like surface electrode layer has an opening ratio of more than 0.7.

7. The image forming apparatus as in claim 3, wherein an electric field strength between the second conductive layer and the surface electrode layer is more than 40 V/micron.

8. An image forming apparatus, comprising:

an image carrying member having an insulating layer formed on a first conductive layer, the image carrying member moving toward a direction;

a photosensitive member having a photosensitive layer formed on a second conductive layer, the photosensitive member being supported so that the photosensitive layer is opposed to the insulting layer of the image carrying member, the photosensitive layer comprises a charge generating layer which generates a charge when irradiated with light and a charge transporting layer which transports the charge from the charge generating layer to the surface of the photosensitive member, the charge generating layer is formed in a belt-like shape and extends at a right angle to the moving direction of the image carrying member;

a voltage applying means for applying a voltage between the first conductive layer and the second conductive layer; and an exposure means for exposing the photosensitive member to generate a charge in the charge generating layer, said generated charge is transported toward the surface of the photosensitive member for discharging between the photosensitive member and the image carrying member to form an electrostatic latent image on the image carrying member.

9. The image forming apparatus as in claim 8, wherein the charge generating layer has a width narrower than the diameter, in the moving direction of the image carrying member, of the light irradiated from the light source.

10. The image forming apparatus as in claim 8, wherein the belt-like shape of the charge generating layer is discontinuous in a direction of its right angle extension.

11. An image forming apparatus, comprising:

an image carrying member having an insulating layer formed on a first conductive layer, the image carrying member moving toward a direction;

a photosensitive member having a photosensitive layer formed on a second conductive layer, the photosensitive member being supported so that the photosensitive layer is opposed to the insulating layer of the image carrying member;

a voltage applying means for applying a voltage between the first conductive layer and the second conductive layer; and a shield member for shielding a portion of light irradiated from an exposure means, the shield member being of a shape having at least one slit extending at a right angle to the moving direction of the image carrying member; and wherein the exposure means is for exposing the photosensitive member to generate a charge in the photosensitive member that discharges between the image carrying member and the photosensitive member, thereby forming an electrostatic latent image on the surface of the image carrying member.

12. The image forming apparatus as in claim 11, wherein the slit of the shield member has a width narrower than the diameter, in the moving direction of the image carrying member, of the light irradiated from the light source.

13. An image forming apparatus, comprising:

an image carrying member having an insulating layer formed on a first conductive layer, the image carrying member moving toward a direction;

a photosensitive member having a photosensitive layer formed on a second conductive layer, the photosensitive member being supported so that the photosensitive layer opposed to the insulating layer of the image carrying member, the second conductive layer being formed in a belt-like shape and extending at right angle to the moving direction of the image carrying member;

a voltage applying means for applying a voltage between the first conductive layer and the second conductive layer; and an exposure means for exposing the photosensitive member for generating charge in the photosensitive member to discharge between the image carrying member and the photosensitive member, thereby, an electrostatic latent image is formed on the surface of the image carrying member.

14. The image forming apparatus as in claim 13, wherein the second conductive layer has a width smaller than the diameter of the exposure spot which exposes the photosensitive member.

15. An image forming apparatus, comprising:

an image carrying member having an insulating layer formed on a first conductive layer, the image carrying member moving toward a direction;

a photosensitive member having a photosensitive layer formed on a second conductive layer, the photosensitive member being supported so that the photosensitive layer is opposed to the insulating layer of the image carrying member, the second conductive layer having a projection which is formed in a belt-like shape and extends at a right angle to the moving direction of the image carrying member, said projection having a width smaller than the diameter of an exposure spot that exposes the photosensitive member;

a voltage applying means for applying a voltage between the first conductive layer and the second conductive layer; and an exposure means for exposing the photosensitive member to generate a charge in the photosensitive member that discharges between the image carrying member and the projection, thereby forming an electrostatic latent image on the surface of the image carrying member.

* * * * *